US006659595B2

(12) United States Patent
Yamaguchi et al.

(10) Patent No.: US 6,659,595 B2
(45) Date of Patent: Dec. 9, 2003

(54) LIQUID JET RECORDING HEAD

(75) Inventors: Yukuo Yamaguchi, Tokyo (JP); Yutaka Koizumi, Kanagawa (JP); Takeshi Yamakubo, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/361,621

(22) Filed: Feb. 11, 2003

(65) Prior Publication Data

US 2003/0156160 A1 Aug. 21, 2003

(30) Foreign Application Priority Data

Feb. 15, 2002 (JP) ..... 2002-039242

(51) Int. Cl.[7] ..... B41J 2/05
(52) U.S. Cl. ..... 347/58; 347/65
(58) Field of Search ..... 347/20, 54, 56–58, 347/59, 63, 65

(56) References Cited

U.S. PATENT DOCUMENTS 6,419,344 B2 * 7/2002 Fujii et al. ..... 347/54

FOREIGN PATENT DOCUMENTS

EP 0581298 A2 * 2/1994 ..... 347/58

* cited by examiner

*Primary Examiner*—Judy Nguyen
*Assistant Examiner*—An H. Do
(74) *Attorney, Agent, or Firm*—Fitzpatrick, Cella, Harper & Scinto

(57) ABSTRACT

A recording element substrate has a plurality of recording elements are provided, a wiring sheet is provided at a position to surround a periphery of the recording element substrate to transmit a recording signal to the recording element substrate, a wiring substrate is electrically connected to one end portion of the wiring sheet to input a recording signal from an exterior, and a flow path forming member supplies recording liquid to the recording element substrate. When the flow path forming member is joined to a frame body having a common liquid chamber, in a state in which the an end of the wiring substrate is supported by the flow path forming member, a liquid jet recording head is held due to opposing both end portions of another end portion of the wiring substrate being respectively inserted and engaged with a set of engaging grooves provided at the frame body.

21 Claims, 16 Drawing Sheets

LIQUID JET RECORDING HEAD

BACKGROUND OF THE INVENTION

1. Field of the Invention

The present invention relates to a liquid jet recording head that jets a liquid such as a recording liquid or the like from discharge ports (orifices) and forms droplets.

2. Description of the Related Art

Recording apparatuses having functions of a printer, a copier, a facsimile or the like, or recording apparatuses used as a multifunction electronic machine including a computer, a word processor and the like, or as an output device of a work station, are structured so as to record images on a medium to be recorded such as a recording paper, a plastic thin plate or the like on the basis of image information. These kinds of recording apparatuses can be classified into an ink jet system, a wire dot system, a thermal system, a laser beam system and the like in accordance with the recording system.

In a serial type recording apparatus that uses a recording system main-scan in a direction intersecting a conveying direction (sub-scanning direction) of the medium to be recorded, the medium to be recorded is set at a predetermined recording position. Thereafter, by repeating the operations of recording (main scan) the image by recording means loaded on a carriage moving along the medium to be recorded, and feeding a predetermined amount of paper (pitch-feeding) after one line has been recorded, and thereafter, recording (main scan) the image of the next line, recording of the entire image on the medium to be recorded is carried out.

On the other hand, in a line type recording apparatus in which recording is carried out by only sub-scanning in the conveying direction of the medium to be recorded, the medium to be recorded is set at a predetermined recording position. By sequentially repeating operations, after recording of one line is collectively carried out, of feeding a predetermined amount of paper (pitch feeding) and then collectively recording the next line, recording of the entire image is carried out on the medium to be recorded.

As typical recording apparatuses which use such serial type and line type liquid jet systems, there is a recording apparatus in which a liquid jet recording head is loaded. Such a recording apparatus is a so-called non-impact recording system recording apparatus, and can carry out high-speed recording and recording for various types of median to be recorded, and has the features that noise at the time of recording does not substantially arise.

Among such liquid jet recording heads, in particular, a liquid jet recording head which discharges a recording liquid by utilizing thermal energy can form a flow path at a high density and can be made more compact, by forming an electrical thermal converter, an electrode, a flow path wall, a top plate, an orifice plate and the like which are film-formed on a substrate through a semiconductor process such as etching, vacuum deposition, sputtering or the like.

As this type of liquid jet recording head, a jetting method using electrical thermal converting elements has been known as a typical jetting method, there is a method in which recording is carried out on the medium to be recorded by discharging droplets from extremely small discharge ports.

Hereinafter, one example of a conventional liquid jet recording head will be described with reference to the drawings. Generally, the liquid jet recording head is structured by having a recording unit for forming droplets and a recording liquid supplying section for supplying a recording liquid to the recording unit.

A perspective view of the exterior of the conventional liquid jet recording head is shown in FIG. 21, and an exploded perspective view of the conventional liquid jet recording head is shown in FIG. 22.

As shown in FIG. 21 and FIG. 22, the conventional liquid jet recording head has recording element substrates 201 discharging droplets, a supporting substrate 202 supporting the recording element substrates 201, wiring sheets 203 and a terminal wiring substrate 205 which are for supplying a recording signal to the recording element substrates 201, and a flow path forming member 206 having a flow path for supplying the recording liquid to the recording element substrates 201.

The recording element substrate 201 has an unillustrated electrical thermal converting element (heater) which is an energy generator, and discharge ports 201*a* provided at positions facing the electrical thermal converting element. Further, the recording element substrates 201 are joined so as to be laminated on the supporting substrate 202 formed from, for example, aluminum or ceramics.

On the supporting substrate 202, the wiring sheets 203, which are for transmitting electric pulse signals to the recording element substrates 201 and which are formed from TAB (Tape Automated Bonding), FPC (Flexible Printed Circuit) or the like, are adhered. The recording element substrates 201 and the wiring sheets 203 are electrically connected by wire bonding, lead bonding or the like.

Further, one end of the wiring sheet 203 is electrical connected to the terminal wiring substrate 205 for electrically connection to a drive controlling section (not shown) which the recording apparatus has. The terminal wiring substrate 205 is formed from a PWB (Printed Wiring Board), TAB, FPC or the like. A contact system connecting terminal 204, to which the drive controlling section is electrically connected, is provided on the main surface of the wiring substrate 205.

Although not illustrated, bosses provided at the flow path forming member 206 are inserted into holes of the terminal wiring substrate 205, and the flow path forming member 206 and the terminal wiring substrate 205 are joined and fixed by heat-welding, an adhesive or the like.

Also, the flow path forming member 206 has recording liquid supplying paths 206*a* for supplying recording liquid to the recording element substrates 201.

Moreover, due to the supporting substrate 202 being joined and fixed to the flow path forming member 206, recording liquid stored in an unillustrated recording liquid tank is supplied to the recording element substrates 201 through the recording liquid supplying paths 206*a* of the flow path forming member 206.

The liquid jet recording head described above has a structure in which the plurality of recording element substrates 201 are provided so as to be laminated on the single supporting substrate 202. However, as another structure, there is also a liquid jet recording head in which the single recording element substrate 201 is provided so as to be laminated on the supporting substrate 202.

As described above, when the liquid jet recording head at which the single recording element substrate 201 is mounted is loaded in a recording apparatus, there are a form in which the single liquid jet recording head is loaded and a form in which the plurality of liquid jet recording heads are loaded.

In the liquid jet recording head which is structured such that the plurality of recording element substrates 201 are laminated on the supporting substrate 202, because the individual recording element substrates 201 are laminated by semiconductor mounting technique, the relative positions between the respective recording element substrates are precisely disposed on the supporting substrate. On the other hand, in a form in which the plurality of liquid jet recording heads, in which a single recording element substrate is laminated on the supporting substrate, are loaded in the recording apparatus, the plurality of liquid jet recording heads are individually and respectively positioned on the carriage (or a accommodating portion for the liquid jet recording heads) of the recording apparatus. Therefore, the accuracy of the relative positions between the recording element substrates is a value in which the positional accuracy of the respective recording element substrates and the positional accuracy of loading the respective liquid jet recording heads at the carriage are added.

As described above, the liquid jet recording head using the electrical thermal converting element has a pressure chamber in which the electrical thermal converting element is provided. Thermal energy is applied to the recording liquid by applying an electrical pulse which is the recording signal to the pressure chamber. The bubble pressure at the time of bubbling (at the time of film boiling) of the recording liquid caused by the change of the phase of the recording liquid at that time is utilized for discharging the recording droplets.

In addition, in a case of the liquid jet recording head using the electrical thermal converting system, there are a method in which recording liquid is discharged parallel to the substrate on which the electrical thermal converting elements are aligned (hereinafter, called an edge shooter), and a method in which recording liquid is discharged perpendicular to the substrate on which the electrical thermal converting elements are aligned (hereinafter, called a side shooter).

In such a liquid jet recording head, when the temperature of the recording element substrate has excessively risen, during recording, abnormalities arise in electric pulse which is the recording signal, the bubbling state of the recording liquid or the like, and there is the concern that the recording state will deteriorate. Therefore, generally, some heat discharging countermeasures are applied to the interior of the liquid jet recording head.

As a heat discharging countermeasure, in the case of the edge shooter type liquid jet recording head, as described above, there are many cases in which a supporting substrate formed from a material such as, for example, aluminum, an aluminum alloy, ceramics or the like is adhered as a heat discharging member on the rear surface of the recording element substrate formed from an Si material.

On the other hand, in a case of the side shooter type liquid jet recording head, as a simple heat discharging countermeasure, there is a method in which heat discharge is carried out by the recording liquid which is discharged through the rear surface of the recording element substrate from the recording liquid storing medium. As another heat discharging countermeasure, in the side shooter type liquid jet recording head in which it is easy for the temperature to rise because the recording elements highly dense, there are methods such as a supporting substrate, which serves as a heat discharging member at which to contact surface area with the recording element substrate can be relatively large, is provided, and the recording element substrate is joined to and fixed on the supporting substrate or the like.

SUMMARY OF THE INVENTION

As described above, in the case of the recording apparatus of the form in which the plurality of liquid jet recording heads at which a single recording element substrate is mounted are loaded so as to be aligned on the carriage, there is the problem that the width of the entire liquid jet recording head is wide.

Further, on the other hand, because spaces partitioning the respective liquid jet recording heads are formed on the carriage, as compared with a recording apparatus at which is loaded an liquid jet recording head at which a plurality of recording element substrates are mounted, the width of the carriage is wider, which is a factor in causing the entire recording apparatus to become large.

Furthermore, in a liquid jet recording head at which a plurality of recording element substrates are mounted, due to some of the electric wiring paths being in common, the total number of the connecting terminals on the liquid jet recording head can be reduced. On the other hand, in a liquid jet recording head at which a single recording element substrate is mounted, it is difficult to make the connecting terminals be used in common. Therefore, the total number of the connecting terminals is larger than that of the liquid jet recording head at which a single recording element substrate is mounted, and due to the layout of these connecting terminals, the mounting space which the entire liquid jet recording head occupies on the carriage becomes large.

Moreover, in the conventional liquid jet recording head, because it is necessary to ensure, at the flow path forming member, a holding region for holding the terminal wiring substrate having the connecting terminals, the flow path forming member becomes large. Accompanying this increase in size of the flow path forming member, in the manufacturing process of the liquid jet recording head, the installation space which the manufacturing line of the flow path forming member occupies is large, and productivity deteriorates.

Thus, an object of present invention is to provide a liquid jet recording head which aims to make the liquid jet recording head compact and which has improved productivity.

In order to achieve the above-described object, the liquid jet recording head of the present invention has a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate having a terminal portion which is electrically connected to one end portion of the wiring sheet and is for input of recording signal from an exterior; and a flow path forming member at which recording liquid supplying paths for supplying recording liquid to the recording element substrate are provided. One end portion of the wiring substrate is supported by the flow path forming member. Further, when the flow path forming member is joined to a holder member which detachably holds a recording liquid storage unit in which recording liquid is stored at the interior thereof or a recording liquid storage tank in which recording liquid is stored at the interior thereof, due to side end portions facing another end portion of the wiring substrate being respectively inserted into and engaged with a set of engaging grooves provided at the recording liquid storage unit or the holder member in a state in which the one end portion of the wiring substrate is supported by the flow path forming member, the wiring substrate is held by the flow path forming member and the recording liquid storage unit or the holder member.

Further, the liquid jet recording head relating to the present invention is structured by connecting the holder member, which detachably holds the recording liquid storage unit in which recording liquid is stored at the interior thereof or the recording liquid storage tank in which recording liquid is stored at the interior thereof, to a recording unit for carrying out recording on a medium to be recorded, the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate having a terminal portion which is electrically connected to one end portion of the wiring sheet and is for input of recording signal from an exterior; a flow path forming member at which recording liquid supplying paths for supplying recording liquid to the recording element substrate are provided; and a porous member for filtering recording liquid. The one end portion of the wiring substrate is supported by the flow path forming member, and another end portion thereof is respectively engaged with a set of engaging grooves provided at the recording liquid storage unit or the holder member. The wiring substrate is thereby held by the flow path forming member and the recording liquid storage unit or the holder member.

In accordance with the liquid jet recording head which is structured as described above relating to the present invention, as compared with a structure in which the wiring substrate is fixed to the flow path forming member by, for example, heating and press-fixing, there is no need to provide spaces for forming holes for heating and press-fixing on the wiring substrate, and the width of the wiring substrate can be made narrow. In accordance therewith, the width of the entire liquid jet recording head corresponding to the width of the wiring substrate can be made compact.

Further, in accordance with this liquid jet recording head, when the flow path forming member and the recording liquid storage unit or the holder member are assembled, the one end portion of the wiring substrate is inserted into and held at the engaging grooves provided at the recording liquid storage unit or the holder member. Therefore, it is possible to omit a manufacturing process for fixing the wiring substrate, and an improvement in the productivity can be achieved. Moreover, because the wiring substrate can be easily removed from the recording liquid storage unit or the holder member, the disassembly work in which the liquid jet recording head is disassembled into the recording unit and the recording liquid storage unit or the holder member can be easily carried out, and the recycling performance can be improved.

Further, in the liquid jet recording head relating to the present invention, the wiring substrate is held over the flow path forming member and the recording liquid storage unit or the holder member. In accordance therewith, only the other end portion side of the wiring substrate is held by the flow path forming member. Namely, in the flow path forming member, there is no need to provide a receiving space over the entire region of the terminal wiring substrate as in the structure of the conventional liquid jet recording head. As a result, in the flow path forming member, the degrees of freedom of designing are improved, and it is possible to attain optimization of the shape of the member, and it is possible to achieve compactness. Therefore, the space for installing the flow path forming member is made small, and the productivity is markedly improved.

Further, in the liquid jet recording head relating to the present invention, positioning portions which position the wiring substrate respectively with respect to three axial directions are provided at the recording unit. In accordance therewith, portions which affect discharging performance and mechanical accuracy of the liquid jet recording head can be concentrated at the recording unit. Accordingly, because the minimum functions which are necessary for storing the recording liquid may be provided at the recording liquid storage unit, it is possible to select inexpensive materials and form the recording liquid storage unit. Further, in the same way, because the function of detachably holding the recording liquid storage tank may be provided at the holder member, it is possible to select inexpensive materials and form the holder member. Namely, due to the functions and parts accuracy being separated and areas of which functions and parts accuracy are required being concentrated at the recording unit in this way, the productivity is markedly improved, and as a result, a high-performance liquid jet recording head can be inexpensively manufactured.

Further, in accordance with the liquid jet recording head relating to the present invention, a joining piece having elasticity is provided at one of the recording unit and the recording liquid storage unit or the holder member, and a joining portion to which the joining piece is joined is provided at the other. In accordance therewith, the recording unit and the recording liquid storage unit or the holder member can be easily disassembled as compared with a structure in which the members are joined by screws, an adhesive or the like, and the recycling performance is improved. Furthermore, because improvement of productivity can be achieved, the liquid jet recording head can be inexpensively manufactured.

Further, in the liquid jet recording head relating to the present invention, at the recording unit, projection portions are respectively formed at positions facing one another, with the porous member being nipped between them. Distal ends of the projection portions with respect to the thickness direction of the porous member are formed so as to project more than the end surface of the porous member. In accordance therewith, in the manufacturing process of the liquid jet recording head, because the porous member provided at the flow path forming member is protected by the respective projection portions, it is possible to easily handle the flow path forming member, and the productivity of the liquid jet recording head is improved.

Further, the liquid jet recording head relating to the present invention has a recording element substrate at which a plurality of recording elements for discharging recording liquid are provided; a wiring sheet which is provided so as to surround the periphery of the recording element substrate and has flexibility and is for transmitting a recording signal to the recording element substrates; a wiring substrate having a terminal portion which is electrically connected to one end portion of the wiring sheet and is for input of a recording signal from an exterior; and a flow path forming member at which recording liquid supplying paths for supplying recording liquid to the recording element substrate are provided. The liquid jet recording head also has holding means for holding one end portion of the wiring substrate in a state in which it is curved from one of the mutually-facing side end portions of one end portion toward the other. Then, when the flow path forming member is joined to the holder member which detachably holds a recording liquid storage unit in which a recording liquid is stored at the interior thereof or a recording liquid storage tank in which a recording liquid is stored at the interior thereof, due to the opposing side end portions of the end portion of the wiring substrate being respectively inserted into and engaged with the set of engaging grooves provided at the recording liquid storage unit or the holder member in a state in which the one end portion of the wiring substrate is supported by the flow path forming member, the wiring substrate is held by the flow path forming member and the recording liquid storage unit or the holder member.

Further, the liquid jet recording head relating to the present invention is structured by connecting the holder member, which detachably holds the recording liquid storage unit in which recording liquid is stored at the interior thereof or the recording liquid storage tank in which recording liquid is stored at the interior thereof, to a recording unit for carrying out recording on a medium to be recorded, the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate having a terminal portion which is electrically connected to one end portion of the wiring sheet and is for input of recording signal from an exterior; a flow path forming member at which recording liquid supplying paths for supplying recording liquid to the recording element substrate are provided; and a porous member for filtering recording liquid. Due to one end portion of the wiring substrate being held by the holding means in a state it which it is curved from one of the side mutually-opposing end portions of the one end portion to the other side, and due to the other end portion of the wiring substrate being respectively engaged with the set of engaging grooves provided at the recording liquid storage unit or the holder member, the wiring substrate is held by the flow path forming member and the recording liquid storage unit or the holder member.

Further, the liquid jet recording head relating to the present invention is structured by connecting the holder member, which detachably holds the recording liquid storage unit in which recording liquid is stored at the interior thereof or the recording liquid storage tank in which recording liquid is stored at the interior thereof, to a recording unit for carrying out recording on a medium to be recorded, the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate having a terminal portion which is electrically connected to one end portion of the wiring sheet and is for input of recording signal from an exterior; a flow path forming member at which recording liquid supplying paths for supplying recording liquid to the recording element substrate are provided; and a porous member for filtering recording liquid. The set of engaging grooves, in which the opposing side end portions of the one end portion of the wiring substrate are respectively inserted and engaged, are provided at the recording liquid storage unit or the holder member. Furthermore, the flow path forming member has positioning members for positioning the one end portion of the wiring substrate with respect to the flow path forming member; and a set of engaging portions respectively engaging with the opposing both side end portions of the one end portion of the wiring substrate. Then, in a state in which the one end portion of the wiring substrate is held at the flow path forming member by the positioning portions and the set of engaging portions, due to the another end portions of the wiring substrate being engaged with the set of engaging grooves, the wiring substrate is held by the flow path forming member and the recording liquid storage unit or the holder member.

Further, in the liquid jet recording head relating to the present invention, a projection, which is positioned at a substantial center on the straight line connecting the set of engaging portions and contacts the rear surface of the one end portion of the wiring substrate, is provided at the recording unit. In accordance therewith, it is possible to hold the wiring substrate in a curved state. Therefore, in the liquid jet recording head, due to the wiring substrate being held in a curved state, in the manufacturing process of the liquid jet recording head, when an external force in a bending direction is applied to the other end portion of the wiring substrate (the end portion which is at the side opposite one end portion side held by the flow path forming member), because the engaged state by the engaging portions is easily cancelled, the wiring substrate or the recording unit is prevented from being broken.

Further, in the liquid jet recording head relating to the present invention, a distance, in the direction of the thickness of the wiring substrate, between the engaging surfaces at which the engaging portions are engaged with the wiring substrate and the contacting surface at which the projection contacts the wiring substrate, is thinner than the thickness of the wiring substrate. In accordance therewith, it is possible to hold the wiring substrate so as to be curved well.

DETAILED DESCRIPTION OF THE PREFERRED EMBODIMENTS

Hereinafter, concrete embodiments of the present invention will be described with reference to the drawings.

First, the liquid jet recording head of the present embodiment is an ink jet recording system, and in particular thereamong, is a recording head which has means for generating thermal energy as energy used for discharging liquid ink, and in which a system causing change in the state of the ink by the thermal energy is used. By using this system, high density and high precision of characters, images or the like which are recorded are achieved. Particularly, in the present embodiment, a heat generating resistive element is used as the means for generating thermal energy, and the ink is discharged by using pressure by bubbles generated when the ink is heated and film-boiled by the heat generating resistive element. However, the system discharging the ink is not limited to a system by the heat generating resistive element, and for example, a system may be used in which mechanical vibration is applied to the ink by using an electromechanical converting element such as a piezo element or the like and the ink is discharged by using the pressure by the vibration.

Figure 1:
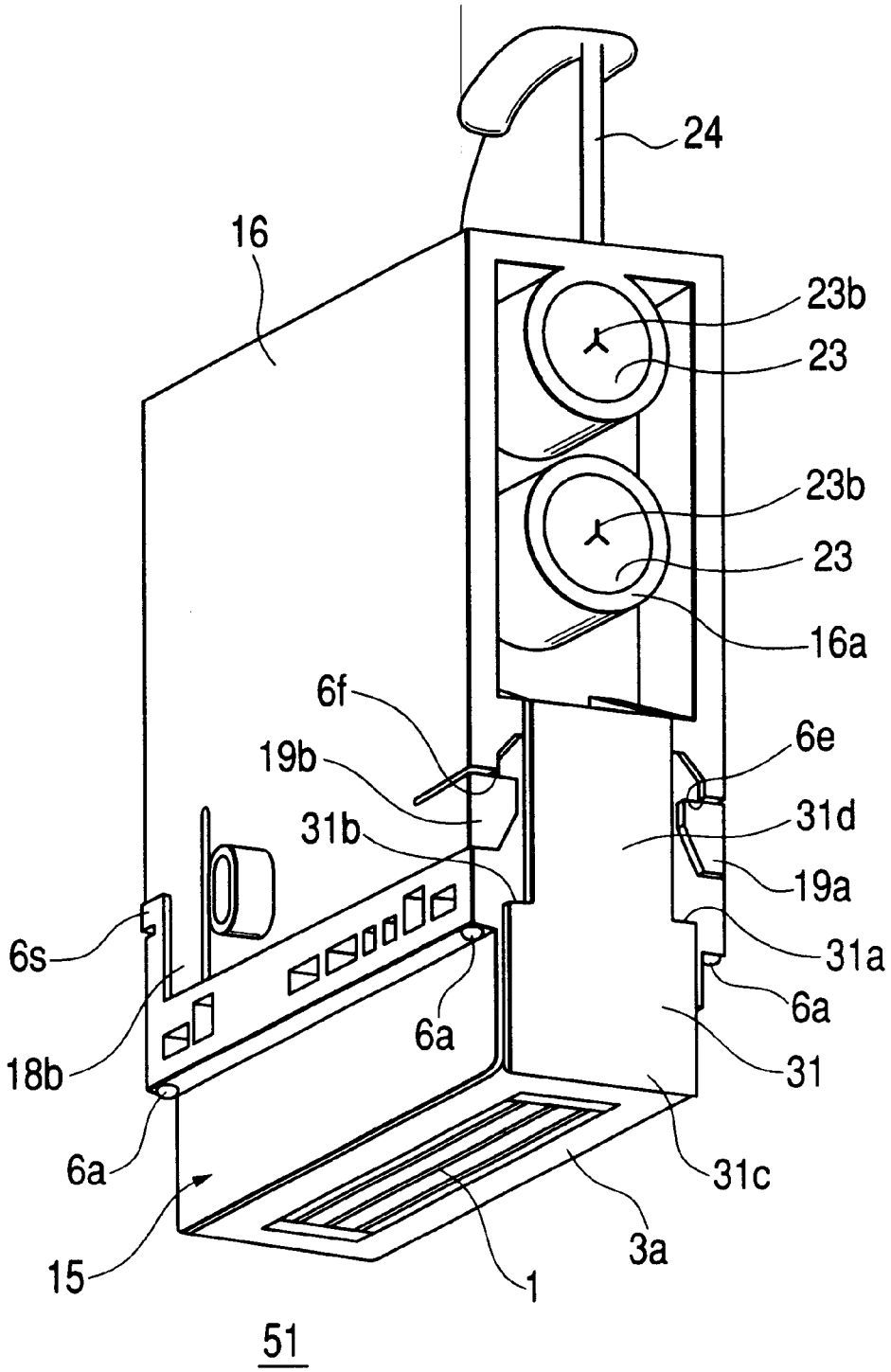
FIG. 1 is a perspective view showing the exterior of a liquid jet recording head of a first embodiment of the present invention.
Figure 2:
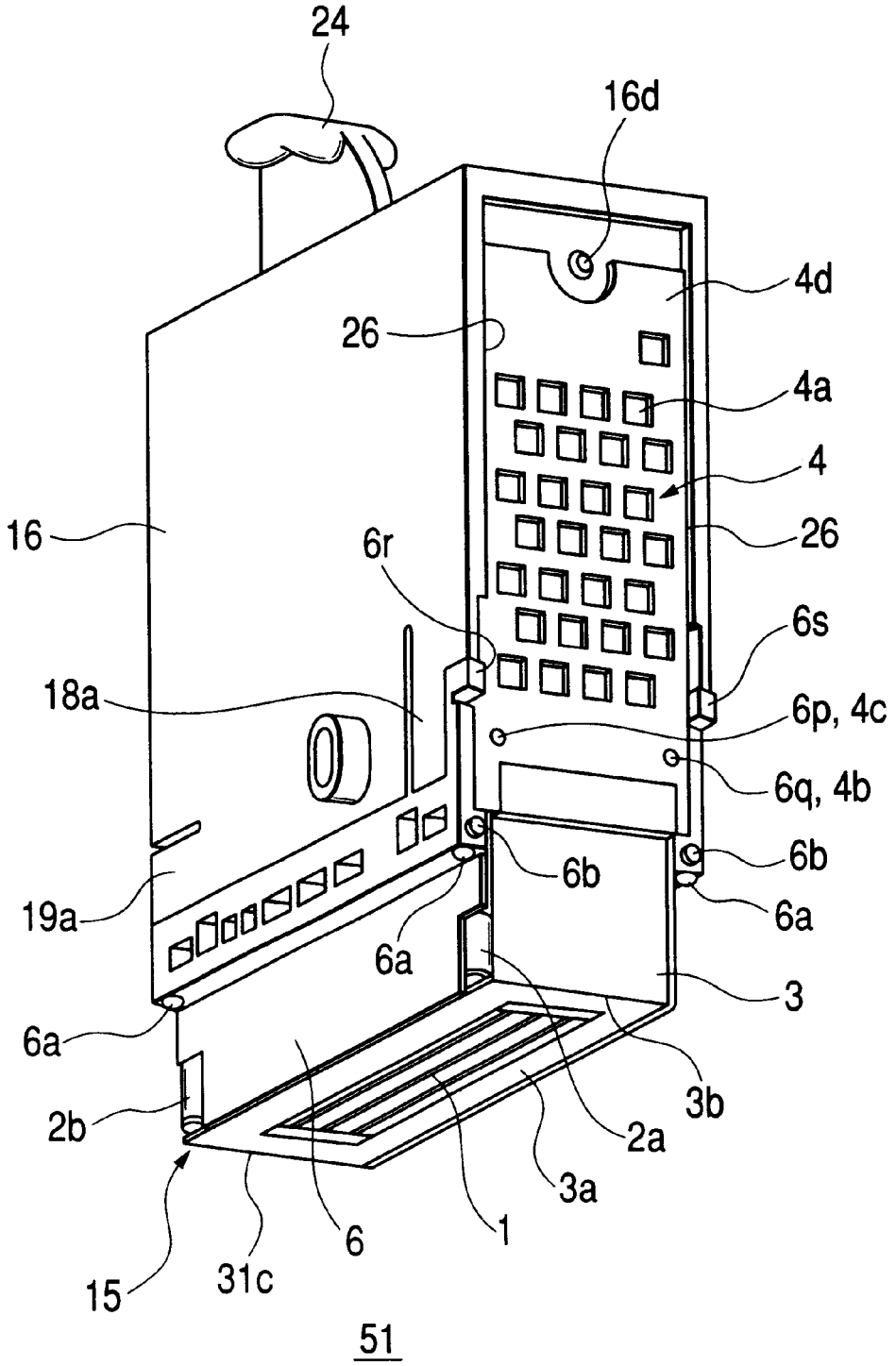
FIG. 2 is a perspective view in which the exterior of the liquid jet recording head is shown from a terminal wiring substrate side.
Figure 3:
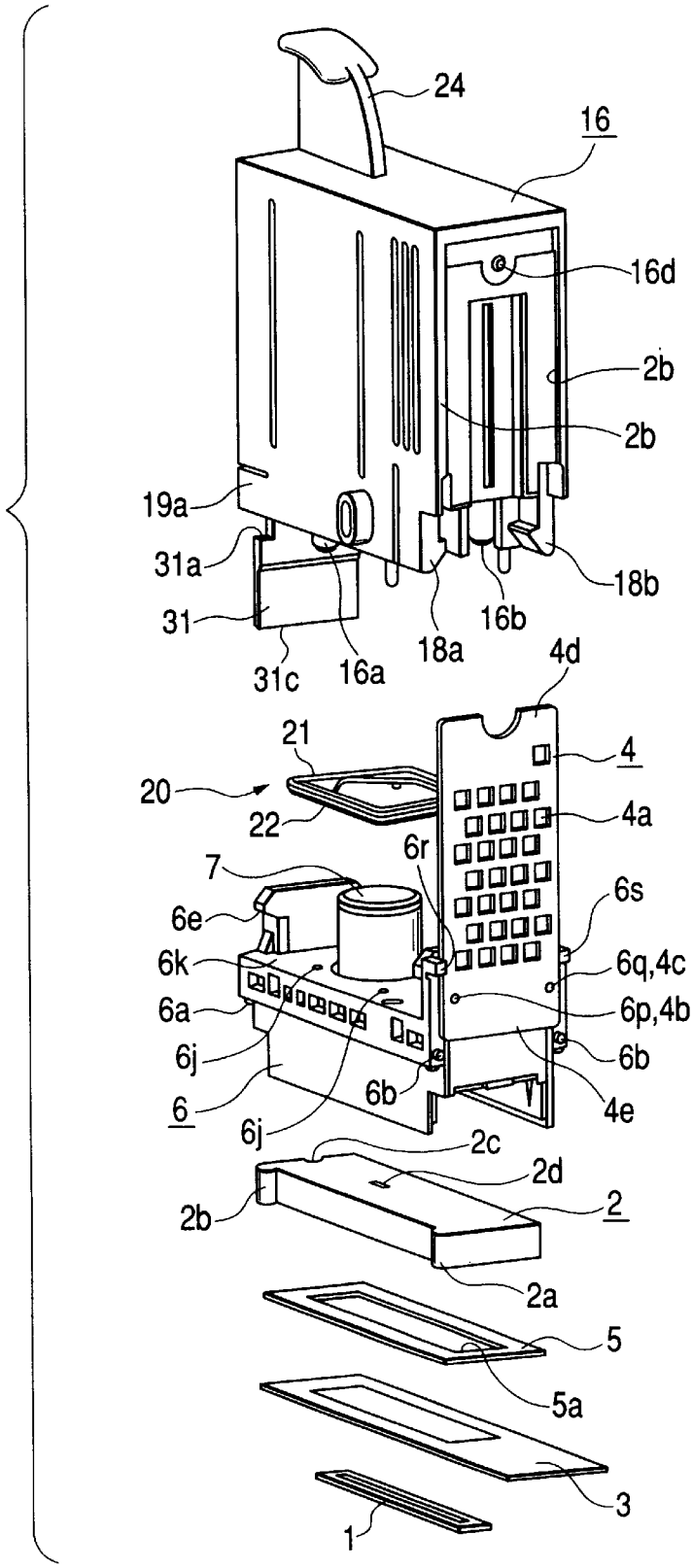
FIG. 3 is an exploded perspective view showing the liquid jet recording head.
Figure 4:
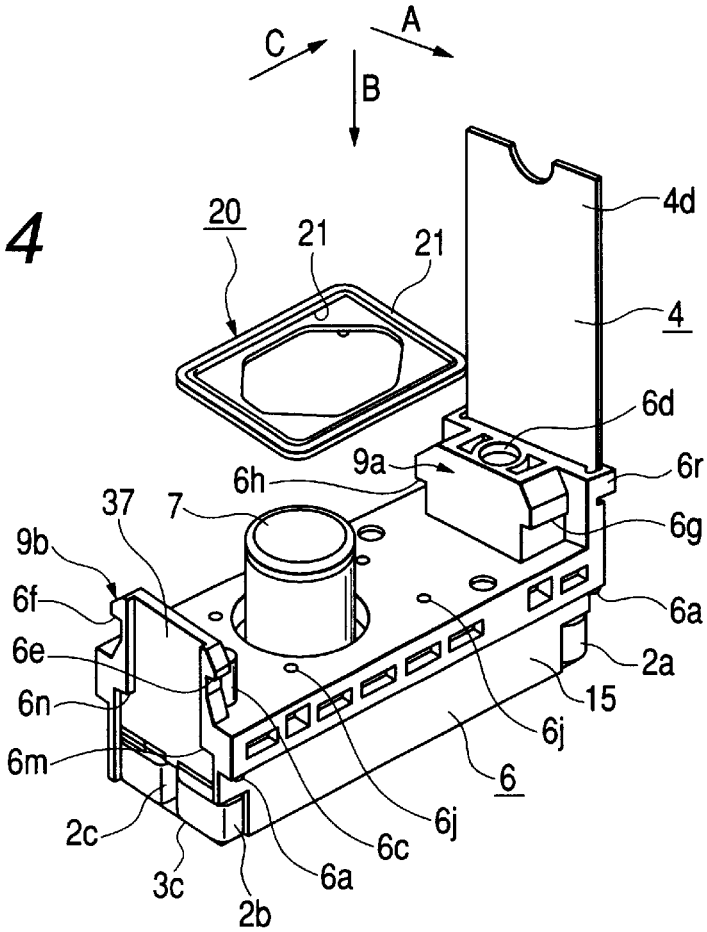
FIG. 4 is a perspective view in which a flow path forming member is shown from above.
Figure 5:
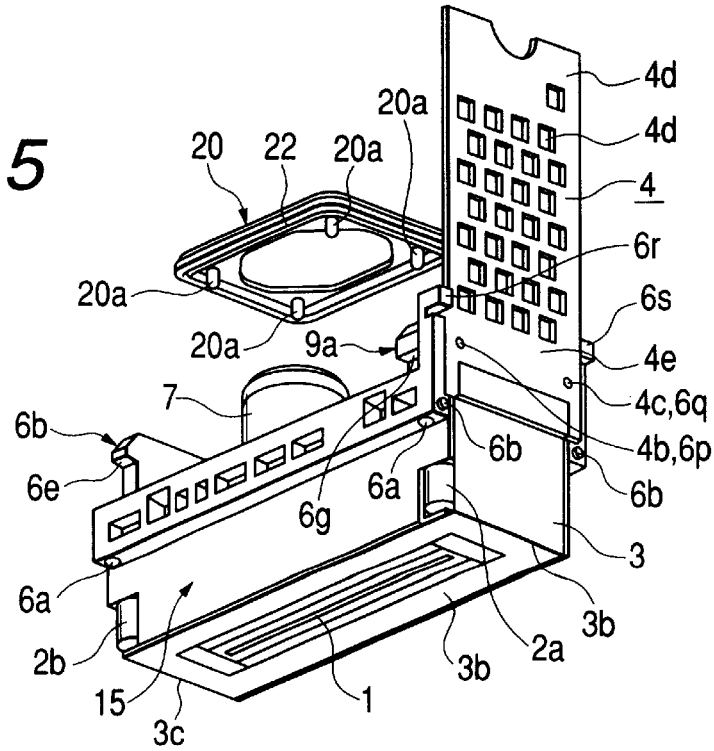
FIG. 5 is a perspective view in which the flow path forming member is shown from below.
Figure 6:
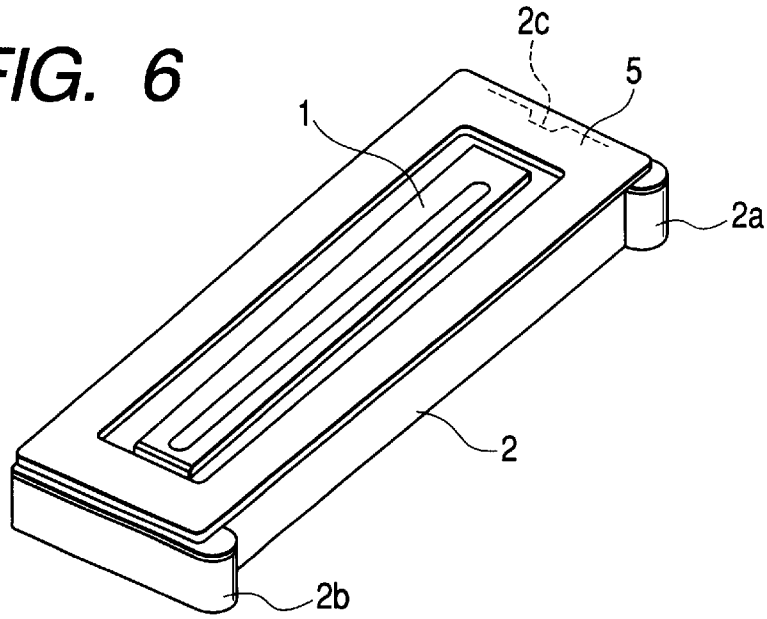
FIG. 6 is a perspective view showing a joined state of a recording element substrate, and first and second plates.
Figure 7:
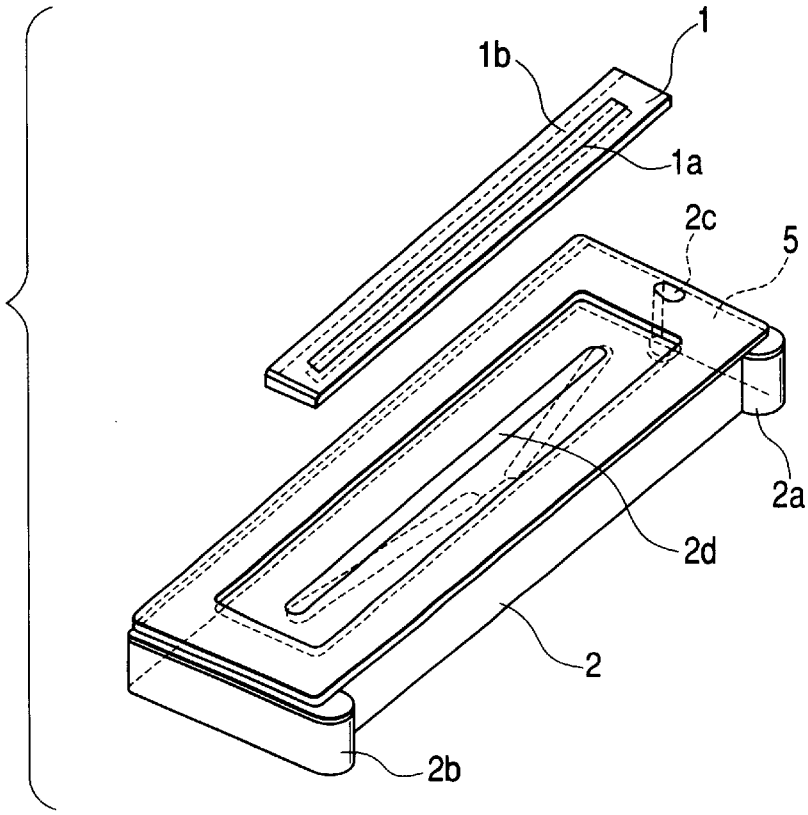
FIG. 7 is an exploded perspective view showing the recording element substrate, and the first and second plates.
Figure 8:
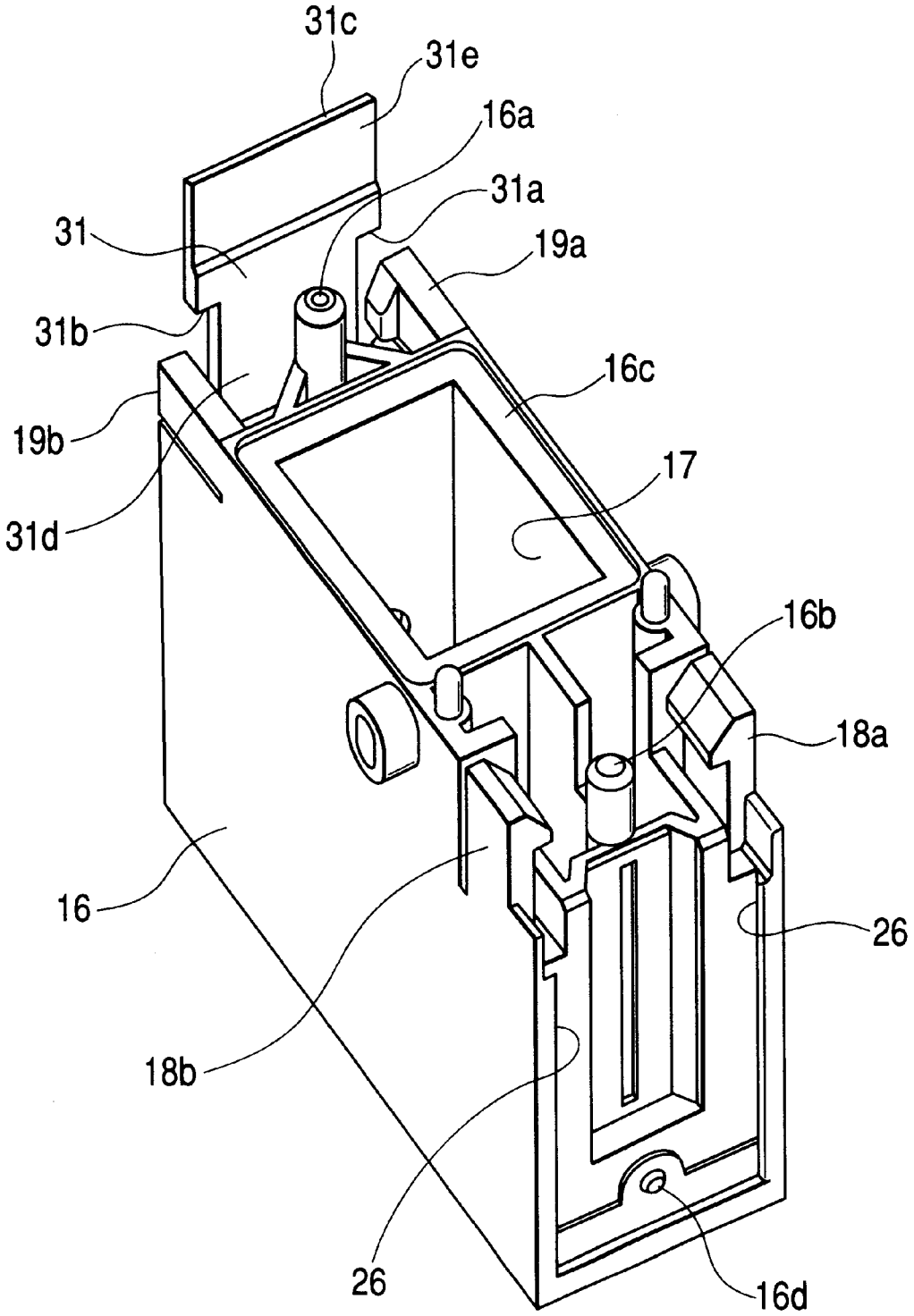
FIG. 8 is a perspective view in which the exterior of a frame body is shown from below.
Figure 9:
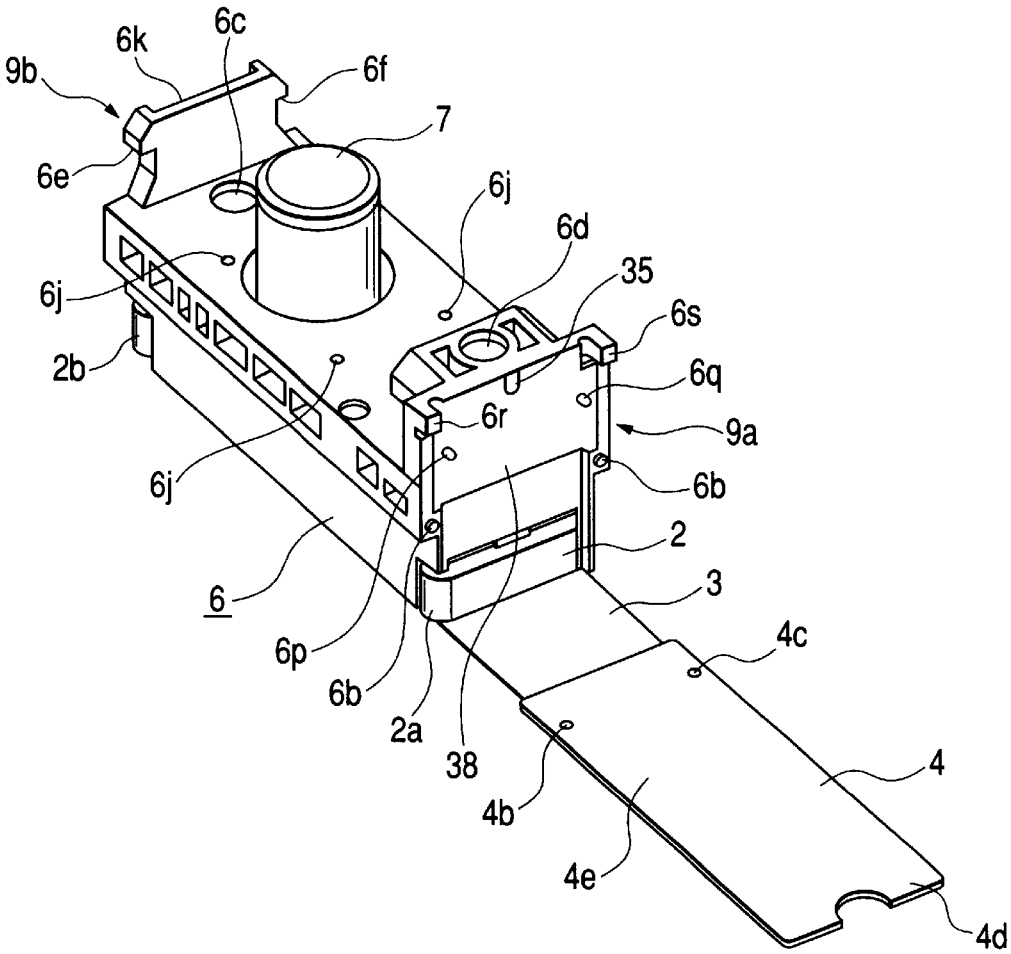
FIG. 9 is a perspective view shown for explaining main portions of the flow path forming member.
Figure 10:
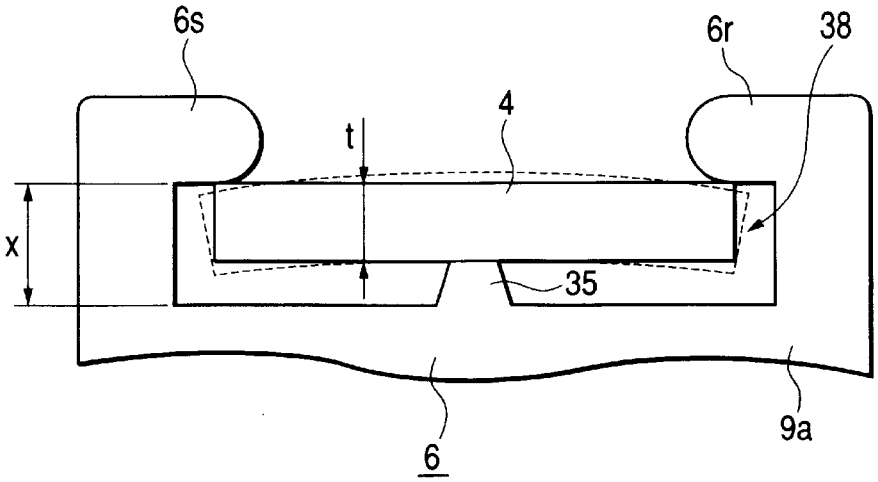
FIG. 10 is a model view shown for explaining engaging claws and projections of the flow path forming member.
Figure 11:
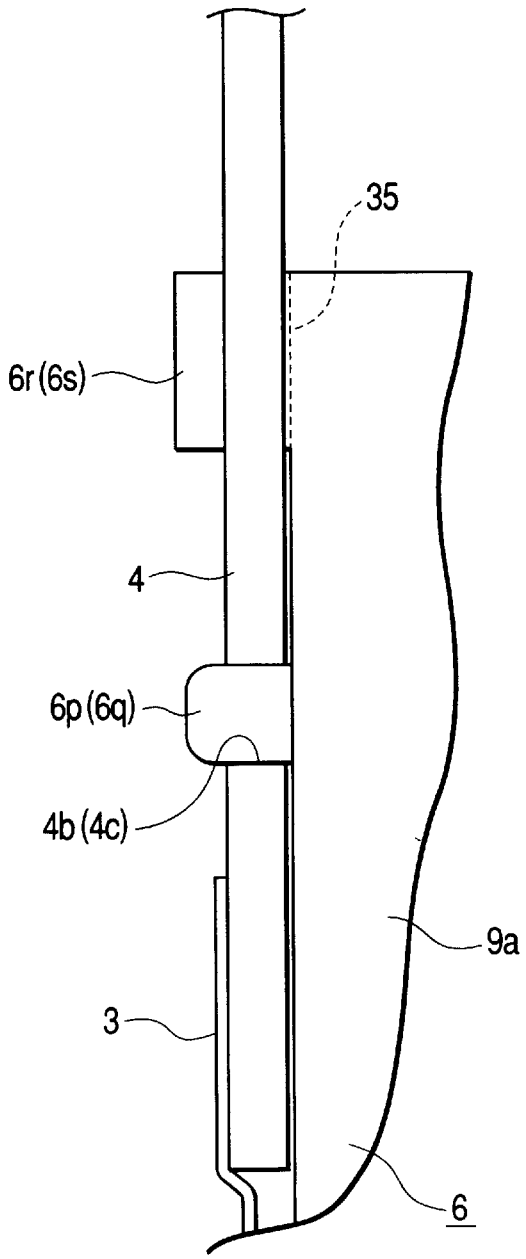
FIG. 11 is a side elevation view showing a state in which the terminal wiring substrate is held by the engaging claws and the projections.
Figure 12:
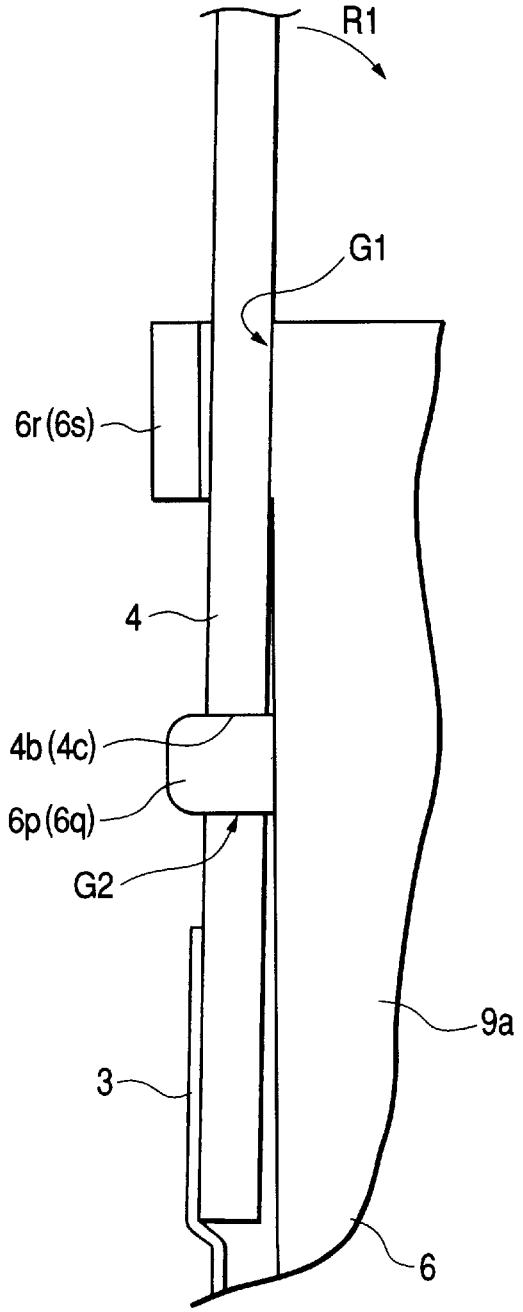
FIG. 12 is a side elevation view showing a state in which the terminal wiring substrate is collapsed toward to the holding concave portion side when there are no projections.
Figure 13:
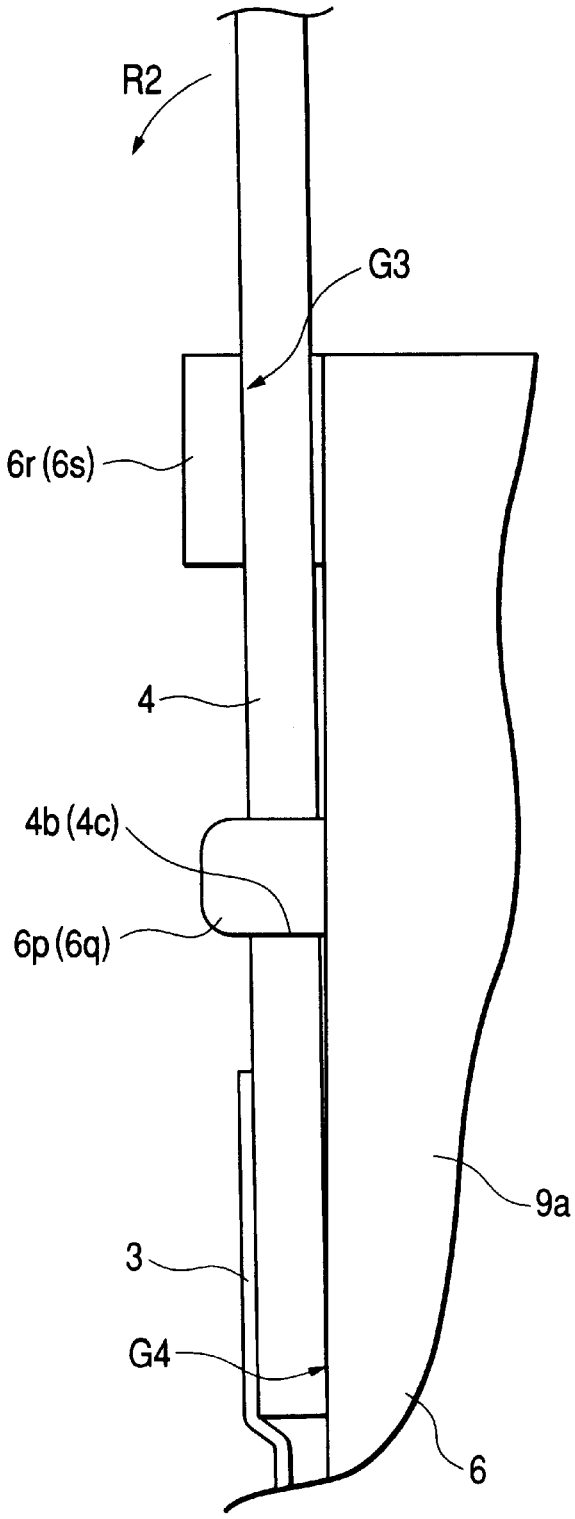
FIG. 13 is a side elevation view showing a state in which the terminal wiring substrate is collapsed toward the outer side of the holding concave portion when there are no projections.
Figure 14:
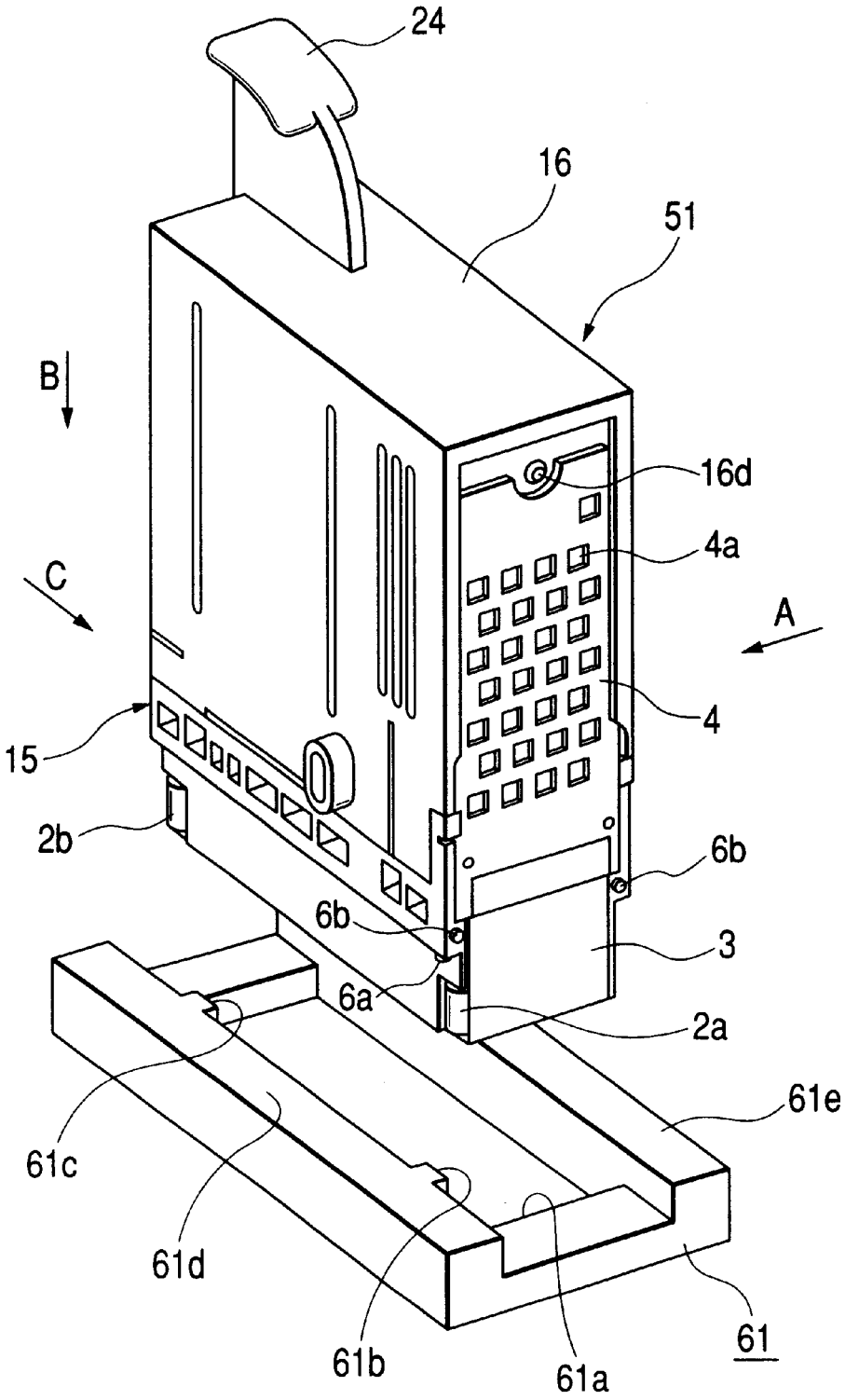
FIG. 14 is a perspective view showing a state in which the liquid jet recording head is to be loaded on the carriage.
Figure 15:
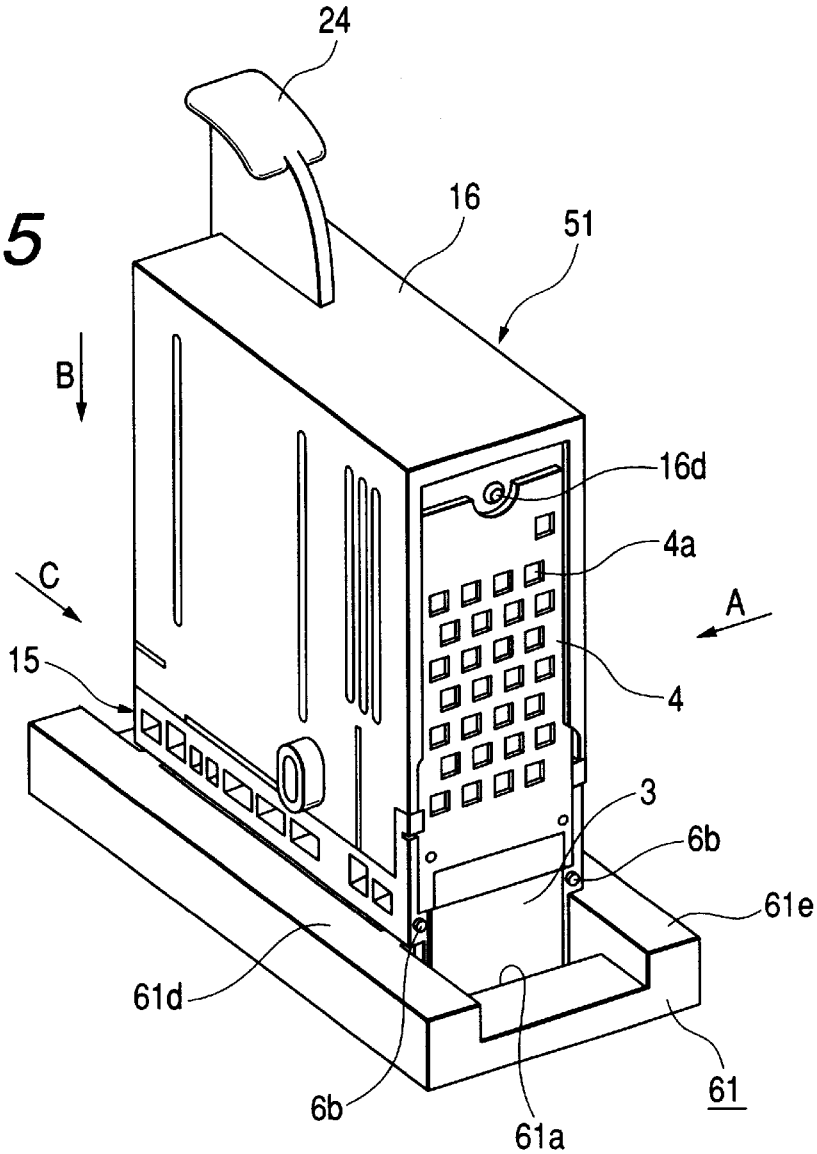
FIG. 15 is a perspective view showing a state in which the liquid jet recording head is loaded on the carriage.
Figure 16:
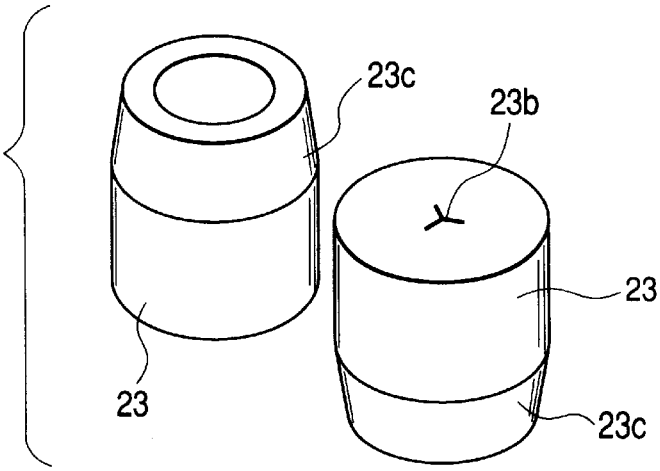
FIG. 16 is a perspective view showing a joint rubber.
Figure 17:
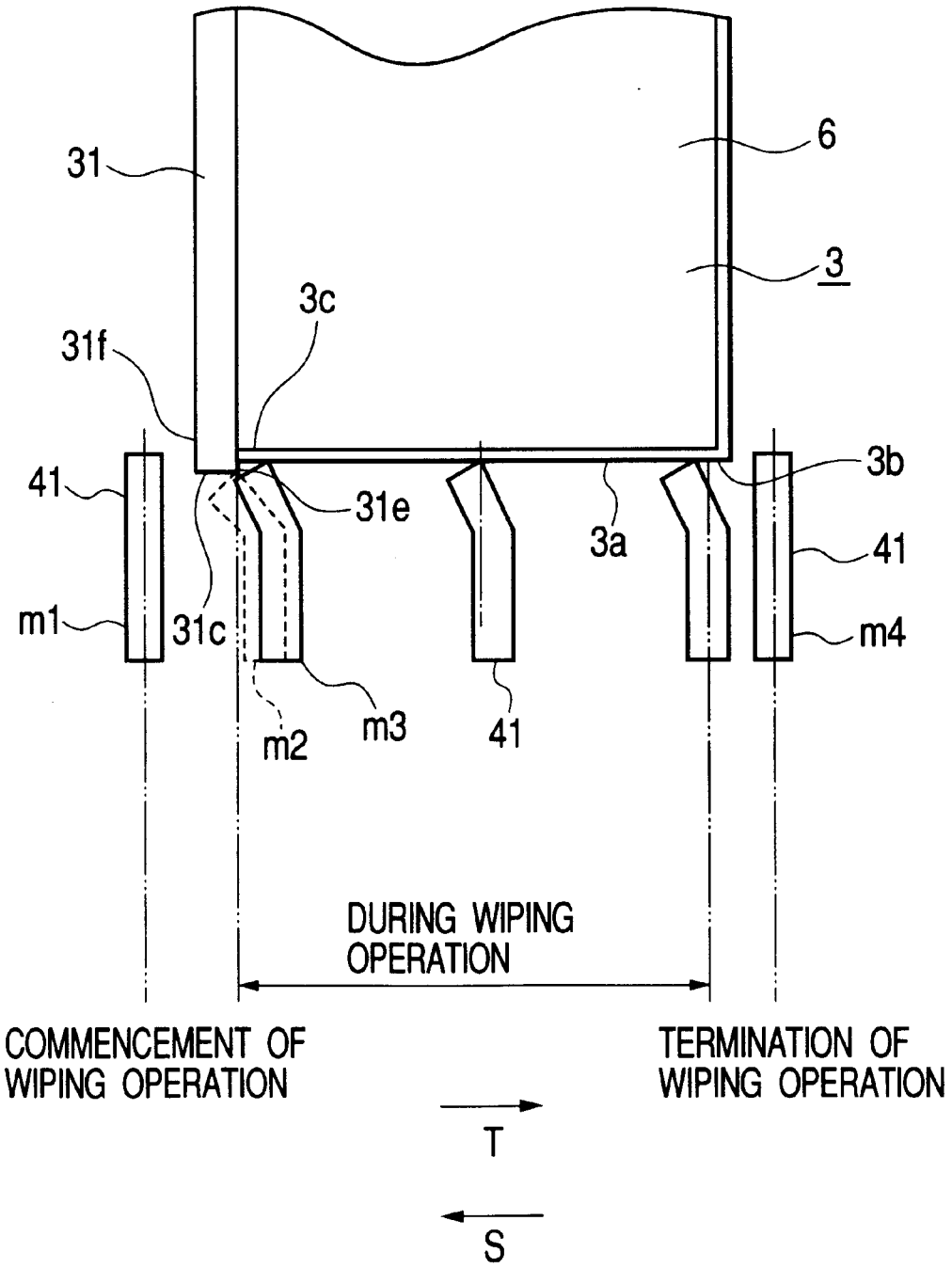
FIG. 17 is a model view shown for explaining wiping operation of a face surface by a blade.

FIG. 1 and FIG. 2 show a perspective view of the exterior of the liquid jet recording head of a first embodiment of the present invention, and FIG. 3 shows an.exploded perspective view of the liquid jet recording head. FIG. 4 and FIG. 5 show a perspective view of a recording unit, FIG. 6 shows a perspective view of a connected state of a recording element substrate, and FIG. 7 shows a perspective view of a separated state of the recording element substrate. FIG. 8 shows a perspective view of the exterior of a frame body. FIG. 9 shows a perspective view for explaining main portions of a flow path forming member. FIG. 10 shows a model view for explaining engaging claws and projections of the flow path forming member, and FIG. 11 shows a state in which a terminal wiring substrate is held by the engaging claws and the projections. FIG. 12 and FIG. 13 show a state in which the terminal wiring substrate is collapsed when there are no projections. FIG. 14 shows a perspective view of a state in which the liquid jet recording head is to be loaded on a carriage, and FIG. 15 shows a perspective view of a state in which the liquid jet recording head is loaded on the carriage. FIG. 16 shows a perspective view of a joint rubber, and FIG. 17 shows a model view for explaining wiping operation of a blade.

First Embodiment

Hereinafter, the liquid jet recording head of the first embodiment will be described with reference to the drawings.

As shown in FIG. 1, FIG. 2, and FIG. 3, a liquid jet recording head 51 of the present embodiment has a recording unit 15 carrying out recording onto a medium to be recorded by discharging recording liquid, and a frame body 16 which accommodates the recording liquid supplied to the recording unit 15 and holds the recording unit 15.

Although the details will be described later, the recording unit 15 largely has a droplet discharging portion discharging droplets on the basis of a recording signal from nozzle rows formed by disposing discharge ports (nozzles) which discharge droplets in rows, and a wiring sheet such as flexible cables, TAB or the like which carries out receipt and transfer of the recording signal to and from a drive controlling section (not shown) which the recording apparatus has. The frame body 16 is structured so as to have the role of a recording liquid storage unit having a recording liquid storeroom (common liquid chamber) accommodating recording liquid or the like supplied to the recording unit 15, and to have the role of a casing for holding the recording unit 15. Further, in the liquid jet recording unit 51, a so-called cartridge system, which is loaded so as to be removable with respect to a carriage which the recording apparatus has, is used.

First, one example of the structure of the recording unit 15 will be described with reference with the drawings.

As shown in FIG. 1 through FIG. 7, the recording unit 15 has a recording element substrate 1 discharging recording liquid, a first plate 2 which is a supporting substrate supporting the recording element substrate 1, a wiring sheet 3 transmitting a recording signal to the recording element substrate 1, a terminal wiring substrate 4 to which one terminal of the wiring sheet 3 is electrically connected and the recording signal is supplied, a second plate 5, a flow path forming member 6 having recording liquid supplying paths supplying the recording liquid to the recording element substrate 1, and a porous member 7 eliminating dust or the like in recording liquid.

At the recording element substrate 1, a plurality of recording elements for discharging recording liquid, and wiring of Al or the like supplying electric power to the respective recording elements, are formed by film molding processing at one side of an Si substrate, and a plurality of recording liquid flow paths and a plurality of discharge ports (not shown) which correspond to these recording elements are formed by photolithography processing. Further, a recording liquid supply port 1*a*, which is for supplying recording liquid to the plurality of recording liquid flow paths communicating with the discharge ports, is formed so as to be open at a rear surface side of the recording element substrate 1.

As shown in FIG. 3, FIG. 6, and FIG. 7, at the first plate 2, cylinder face portions 2*a*, 2*b* are respectively provided at both ends of the side faces in the long side direction thereof. Further, at the first plate 2, a cylinder groove 2*c* is provided at the center of the side surface in the short side direction. Then, by using the cylinder groove 2*c* and a plane reference plane (hereinafter, first reference plane) connecting the two summit portions of the cylinder face portions 2*a*, 2*b* as references, the relative positions and inclination of a recording element arrangement plane of the recording element substrate 1 are respectively adjusted. Thereafter, the recording element substrate 1 is placed and joined on the main surface of the second plate 2. In this way, because the relative positions of the recording element substrate 1 and the first plate 2 are precisely set by a semiconductor mounting technique, it is possible to mount so as to make the inclination amount from the recording element substrate 1 to the recording element arrangement plane small.

Because the first plate 2 is formed in a plate shape, the plane geometry accuracy at the mounting surface of the recording element substrate 1 and the opposite surface thereof, and the parallelism of the mounting surface of the recording element substrate 1 and the opposite surface thereof can be precisely manufactured. As a result, although not illustrated, at a joining apparatus (not shown) of the recording element substrate, the structure of a base on which the first plate 2 is placed can be simplified, and the first plate 2 can be precisely placed on the base. In accordance therewith, because the adjusting accuracy of the recording element substrate 1 with respect to the first plate 2 is improved even more, the relative inclination accuracy between the first reference plane of the first plate 2 and the recording element substrate 1 becomes more precise, and improvement of the productivity of the liquid jet recording head can be achieved.

Further, because the first reference plane of the side surface of the first plate 2 is parallel to the side surface in the long side direction of the recording element substrate 1, the a monitoring region of a work piece at the joining apparatus of the recording element substrate 1 is made narrow, as compared with a case in which these both surfaces are disposed so as to be perpendicular to one another. Therefore, the adjusting operation of the first plate 2 and the recording element substrate 1 is easy, and it is possible to shorten the operating time. In addition, the space on which the work piece is mounted can be made small, and the joining apparatus can be inexpensively manufactured.

Moreover, in the first plate 2, the distance between the summits of the cylinder face portions 2*a*, 2*b* is set to be longer than a length of the recording element array of the recording element substrate 1. Therefore, in accordance with the first plate 2, at the time of the adjusting operations, the inclination of the recording element substrate 1 with respect to the first reference plane can be easily adjusted, and the adjusting accuracy is improved, and the first plate 2 can be stably produced.

In addition, as shown in FIG. 3 and FIG. 7, a recording liquid supplying path 2*d* for supplying recording liquid to the recording element substrate 1 is formed in the first plate 2.

Also, the second plate 5 is fixed to the first plate 2 by adhesion. An opening portion 5*a* for avoiding interference at the time of mounting of the recording element substrate 1 is provided at the center on the main surface of the second plate 5.

On the other hand, the wiring sheet 3 is held by joining one end portion thereof to the main surface of the second plate 5, and is electrically connected to the recording element substrate 1. Moreover, another end portion of the wiring sheet 3 and the terminal wiring substrate 4 are electrically connected to one another through a connecting means such as, for example, an ACF (anisotropy conductive film), lead bonding, wire bonding, a connector or the like.

Note that, in the present embodiment, as the electrical wiring means supplying the recording signal to the recording element substrate 1, the wiring sheet 3 and the terminal wiring substrate 4 are structured as the separate members. However, the wiring sheet 3 and the terminal wiring substrate 4 may be structured so as to be integrally formed by a same member.

The above-described wiring means is a series of wiring portions which electrically connect the wiring sheet 3 and the terminal wiring substrate 4, and applies an electrical signal for discharging recording liquid to the recording element substrate 1.

The terminal wiring substrate 4 is formed in a flat plate shape forming a substantial rectangle, and electrical wiring (not shown) corresponding to the recording element substrate 1 is provided thereat. As shown in FIG. 5, a connecting portion, at which one end of the electrical wiring and one end of the wiring sheet 3 are electrically connected, is provided at one end portion in the longitudinal direction of the terminal wiring substrate 4. Further, at the main surface of the terminal wiring substrate 4, another end of the electrical wiring is connected, and an external signal inputting terminal 4*a*, to which the recording signal from a drive controlling section (not shown) of the recording apparatus is inputted, is provided.

Further, positioning holes 4*b*, 4*c* for positioning with respect to the flow path forming member 6 are respectively provided at the terminal wiring substrate 4. Then, the terminal wiring substrate 4 is positioned and fixed by the positioning holes 4*b*, 4*c* at one side surface of the flow path forming member 6.

As shown in FIG. 4 and FIG. 5, the first plate 2 is joined and fixed by a joining means such as, for example, adhesive, screws or the like to the flow path forming member 6. Due to the first plate 2 and the flow path member 6 being joined to one another, a recording liquid flow path at the first plate 2 side and a recording liquid flow path at the flow path forming member 6 side are communicated.

In addition, spherical positioning bosses 6*a*, 6*b* for positioning the liquid jet recording head 51 with respect to the carriage which will be described later are provided so as to project at the flow path forming member 6. The liquid jet recording head 51 is positioned with respect to the direction of arrow B in FIG. 4 by the positioning boss 6*a*, and is positioned with respect to the direction of arrow C in FIG. 4 by the positioning boss 6*b*.

Moreover, at the flow path forming member 6, the porous member 7 filtering the recording liquid is joined to an upper surface 6*k* side at an opposite side of the side to which the first plate 2 is joined. In the liquid jet recording head 51, the porous member 7 prevents dust from entering in from the upstream of the recording liquid supplying path.

Also at the flow path forming member 6, engaging projection portions 9*a*, 9*b* engaging with the frame body 16 are respectively formed so as to be positioned at the both ends in the longitudinal direction of the flow path forming member 6 on the upper surface 6*k* at the opposite side of the side to which the first plate 2 is joined. Accordingly, the porous member 7 is positioned between the opposing regions of the engaging projection portions 9*a*, 9*b* at the flow path forming member 6.

At the flow path forming member 6, in a state in which the porous member 7 is fastened at the upper surface 6*k* side, positions (hereinafter, simply called heights) of the top end surfaces of the respective engaging projection portions 9*a*, 9*b* with respect to a direction (the thickness direction of the porous member 7) substantially perpendicular to the upper surface 6*k* are formed so as to be slightly higher than a height of the porous member 7.

By the way, in the manufacturing line of the flow path member, after the porous member is fastened to the flow path forming member, process working is carried out on the flow path forming member. At this time, when the flow path forming member is placed on a work bench or the like with the recording liquid discharging side thereof facing vertically upward, namely, with the porous member 7 facing vertically downward, the porous member contacts the work bench. Therefore, there is the concern that the porous member will be damaged at the time of process working. Therefore, in the manufacturing line of a conventional flow path member, when the porous member is placed on a work bench so as to face vertically downward, a jig receiving the porous member of the flow path forming member or the like has been used.

As described above, in the flow path forming member 6, the heights of the engaging projection portions 9*a*, 9*b* are formed so as to be higher than the height of the porous member 7. Thereby, when the porous member 7 is placed on the work bench so as to face vertically downward in the manufacturing line of the flow path forming member 6, it is possible for the porous member 7 to be placed so as not to contact the work bench by being protected by the respective engaging projection portions 9*a*, 9*b*. Accordingly, in accordance with the flow path forming member 6, a jig tool or the like used in the manufacturing line of the conventional flow path member 6 is unnecessary, and the workability can be improved.

Further, in the flow path member 6, the difference between the heights of the respective engaging projection portions 9*a*, 9*b* and the height of the porous member 7 is set to be about less than or equal to 5 mm. By forming the respective engaging projection portions 9*a*, 9*b* to have heights which can protect the porous member 7, the entire flow path forming member 6 is not unnecessarily made large. Therefore, the flow path forming member 6 is an extremely compact shape, and the space which the manufacturing line of the flow path forming member 6 occupies in the manufacturing process of the liquid jet recording head is made small, and a remarkable improvement in the productivity can be achieved.

Furthermore, as shown in FIG. 9, a holding concave portion 38 for holding a bottom end portion 4*e* of the terminal wiring substrate 4 is provided at the engaging projection portion 9*a* of the flow path forming member 6. As shown in FIG. 10 and FIG. 11, positioning pins 6*p*, 6*q* engaged with the positioning holes 4*b* 4*c* of the terminal wiring substrate 4 are respectively formed so as to integrally project at the holding concave portion 38. In addition, a set of engaging claws 6*r*, 6*s* engaging with the opposing both side ends the bottom end portion 4*e* of the terminal wiring substrate 4 are respectively formed so as to integrally project and so as to be positioned in vicinities of the positioning pins 6*p*, 6*q* at the holding concave portion 38.

Moreover, a projection 35 contacting the rear surface of the bottom end portion 4*e* of the terminal wiring substrate 4 is formed so as to integrally project and so as to be positioned at the substantial center of the straight line connecting the respective engaging claws 6*r*, 6*s* at the holding concave portion 38. Further, as shown in FIG. 10, given that the thickness of the terminal wiring substrate 4 is, the distance x between the distal end surface of the projection 35 and the engaging surfaces of the engaging claws 6*r*, 6*s*, in the direction parallel to the thickness direction of the terminal wiring substrate 4, is formed so as to be slightly shorter than the thickness of the terminal wiring substrate 4.

Hereinafter, the state in which the terminal wiring substrate 4 is held by the engaging projection portion 9*a* of the flow path forming member 6 will be described in detail with reference to the drawings.

As shown in FIG. 10 and FIG. 11, after the wiring sheet 3 is electrically joined to the terminal wiring substrate 4 (the state shown in FIG. 9), the terminal wiring substrate 4 is positioned by bending the wiring sheet 3 at a bending portion 3*b* and inserting the positioning pins 6*p*, 6*q* of the flow path forming member 6 into the positioning holes 4*b*, 4*c* at the bottom end portion 4*e* side of the terminal wiring substrate 4. Moreover, at the terminal wiring substrate 4, the bottom end portion 4*e* of the terminal wiring substrate 4 is held at the flow path forming member 6 by the opposing both side ends of the bottom end portion 4*e* being engaged and held by the engaging claws 6*r*, 6*s* of the flow path forming member 6.

Further, at the bottom end portion 4*e* of the terminal wiring substrate 4, the distance x is formed so as to be slightly shorter than the thickness of the terminal wiring substrate 4. Therefore, in the state in which the terminal wiring substrate 4 is held in the holding concave portion 38 by the positioning pins 6*p*, 6*q* and the engaging claws 6*r*, 6*s*, by making the projection 35 contact the rear surface, the terminal wiring substrate 4 is held well along the opposing both sides without generating chattering due to a dispersion of dimensional tolerance in a state in which the terminal wiring substrate 4 is curved as shown by the broken line in FIG. 10.

As described above, in a case in which only the bottom end portion 4*e* is held at the flow path forming member 6, the top end portion 4*d* is not held at the flow path forming member 6. Therefore, the terminal wiring substrate 4 is held in a state in which bending deformation arises when an external force is applied. Namely the terminal wiring substrate 4 is in a state in which only the bottom end portion 4*e* thereof is temporarily held. However, the terminal wiring substrate 4 is respectively positioned with respect to the three directions of the X axis, the Y axis, and the Z axis by being held by the flow path forming member 6.

Further, due to the terminal wiring substrate 4 being held in a state in which it is curved, when external force in the bending direction is applied to the top end portion 4*d* side, the engaged state by the engaging claws 6*r*, 6*s* is easily cancelled. Therefore, the terminal wiring substrate 4 and the recording unit 15 are reliably prevented from breaking.

On the other hand, when the engaged state is cancelled, the terminal wiring substrate 4 is released from stress applied at the time of bending deformation, and immediately returns to its original state of a flat plate by elastic recovery force. Namely, when the engaged state by the engaging claws 6*r*, 6*s* is cancelled, the terminal wiring substrate 4 is held by bending deformation being applied thereto such that permanent strain is not caused at the terminal wiring substrate 4.

Accordingly, although the terminal wiring substrate 4 is stably held by the recording unit 15, the terminal wiring substrate 4 is not firmly held. Therefore, even if external force is applied, breakage of these structural members can be avoided.

Note that, although the flow path forming member 6 described above is structured so as to include the projection 35, another flow path forming member at which engaging projections are not provided will be described. Note that, with respect to this other flow path forming member, for convenience, parts which are the same as those of the flow path forming member 6 are denoted by the same reference numerals, and description thereof will be omitted.

At the time of handling the liquid jet recording head in the manufacturing process, there are cases in which external force is applied to the top end portion 4*d* of the terminal wiring substrate 4 whose bottom end portion 4*e* is held by the flow path forming member.

When such external force is applied, as shown in FIG. 12, there are cases in which the terminal wiring substrate 4 inclines and collapses in the direction of arrow $R_1$ in FIG. 12. In this case, because the bottom end portion 4*e* of the terminal wiring substrate 4 is, in a state of being collapsed in the direction of arrow $R_1$, respectively supported by a facing surface $G_1$ of the holding concave portion 38 facing the engaging claws 6*r*, 6*s* and a peripheral surface $G_2$ of the positioning pins 6*p*, 6*q*, the bottom end portion 4*e* of the terminal wiring substrate 4 is held without falling out from the holding concave portion 38.

In the same way, when external force is applied, as shown in FIG. 13, there are cases in which the terminal wiring substrate 4 inclines and collapses in the direction of arrow $R_2$ in FIG. 13. In this case, because the bottom end portion 4*e* of the terminal wiring substrate 4 is, in a state of being collapsed in the direction of $R_2$, respectively supported by an engaging surface $G_3$ of the engaging claws 6*r*, 6*s* facing the terminal wiring substrate 4 and a bottom end surface $G_4$ of the holding concave portion 38 corresponding to the bottom end of the terminal wiring substrate 4, the bottom end portion 4*e* of the terminal wiring substrate 4 is held without falling out from the holding concave portion 38.

In other words, even if the flow path forming member has a structure at which the projection 35 is not provided, the state of holding the terminal wiring substrate 4 can be maintained when an external force is applied. However, because the projection 35 prevents the terminal wiring substrate 4 from collapsing in the directions of $R_1$ and $R_2$ by holding the bottom end portion 4*e* of the terminal wiring substrate 4 in a state of being curved, the structure in which the projection 35 is provided is preferable.

As described above, when an external force is applied to the terminal wiring substrate 4, because the flow path forming member 6 is held in a state in which the terminal wiring substrate 4 is capable of elastic displacement, the terminal wiring substrate 4 can be reliably held, and breakage of the terminal wiring substrate 4 can be prevented.

A positioning hole 6*c*, which is positioned in the vicinity of the engaging projection portion 9*b* and is for positioning with respect to the frame body 16, is provided at the flow path forming member 6. In addition, a positioning hole 6*d* for positioning with respect to the frame body 16 is provided a top end surface of the engaging projection portion 9*b* facing the frame body 16.

Moreover, at the engaging projection 9*a* of the flow path forming member 6, first catching portions 6*h*, 6*g* with which the frame body 16 is engaged are respectively formed so as to be cut out at the both ends in the short side direction of the recording element substrate 1. Further, at the engaging projection 9*b* of the flow path forming member 6, second catching portions 6*e*, 6*f* with which the frame body 16 is engaged are respectively formed so as to be cut out at the both ends in the short side direction of the recording element substrate 1.

Next, one example of the structure of the frame body 16 will be described with reference to the drawings.

As shown in FIG. 8, the frame body 16 is formed from, for example, a resin material, and has the role of the casing of the liquid jet recording head 51. At the interior of the frame body 16, a common liquid chamber 17, which is for accommodating recording liquid of predetermined amount and for storing the accommodated recording liquid temporarily or until it is used up, is provided.

Further, a projection portion 16*d*, which is a positioning portion positioning the liquid jet recording head 51 with respect to the direction of arrow C in FIG. 4, is provided at the frame body 16. Accordingly, when the liquid jet recording head 51 of the present embodiment is positioned with respect to the arrow C direction, either one of the projection portion 6*b* at the flow path forming member 6 side described above and the projection portion 16*d* at the frame body 16 side is arbitrarily selected, and the positioning is carried out.

Furthermore, a set of engaging grooves 26, with which the opposing both side ends of the top end portion 4*d* of the terminal wiring substrate 4 are respectively engaged, are provided at the frame body 16. These engaging grooves 26 are formed in a rectilinear shapes which are parallel to the direction of joining the recording unit 15 to the frame body 16, and the side thereof adjacent to the recording unit 15 is made to be open. Accordingly, when the frame body 16 and the recording unit 15 are joined, the terminal wiring substrate 4 is inserted into the engaging grooves 26 from the top end portion 4*d* side, and is held at the frame body 16 by the opposing both side ends of the top end portion 4*d* engaging with these engaging grooves 26.

Also at the frame body 16, bosses 16*a*, 16*b* inserted into the positioning holes 6*c*, 6*d* of the flow path forming member 6 are respectively formed so as to integrally project at one end portion adjacent to the flow path forming member 6.

Further, at the frame body 16, first snap fittings 18*a*, 18*b* and second snap fittings 19*a*, 19*b*, which are relatively engaged with the engaging projection portions 9*a*, 9*b* of the flow path forming member 6, are respectively formed so as to be capable of elastic displacement at one end portion adjacent to the flow path forming member 6.

As shown in FIG. 1 and FIG. 8, an extension piece 31 engaged with the engaging projection portion 9*b* of the flow path forming member 6 is integrally formed at the frame body 16 so as to be positioned in the vicinity of the second snap fittings 19*a*, 19*b*. The extension piece 31 is extended toward the recording unit 15 side at a position corresponding to one side surface in the short side direction of the first plate 2 at the recording unit 15 side. A distal end portion 31*c* of the extension piece 31 is provided so as to be extended up to a position covering a side end 3*c* of the wiring sheet 3 of the recording unit 15, and is, in a state in which the frame body 16 and the flow path forming member 6 are joined, made to slightly project in the discharging direction of the recording liquid which is a direction substantially perpendicular to a face surface 3*a* from the face surface 3*a* of the wiring sheet 3. In other words, in a state in which the frame body 16 and the flow path forming member 6 are joined, an inner wall surface 31*e* of the distal end portion 31*c* of the extension piece 31 is adjacent to the side end 3*c* of the wiring sheet 3 facing the periphery of the face surface 3*a*, and the side end 3*c* functions as a protection wall.

Further, the extension piece 31 is formed in a flat plate shape forming a substantially T-shape, and has, at the base end portion side, a elastic displacement portion 31*d* which is capable of elastic displacement in a thickness direction. Moreover, at the extension piece 31, hooks 31*a*, 31*b* engaged with the engaging projection portion 9*b* of the flow path forming member 6 are formed so as to be cut out at the both sides in the width direction which is parallel to the short side direction of the first plate 2. In addition, an engaging concave portion 37 with which the extension piece 31 is engaged is provided on the side surface facing the exterior at the engaging projection portion 9*b* of the flow path forming member 6. Third catching portions 6*m*, 6*n*, with which the hooks 31*a*, 31*b* of the extension piece 31 are engaged, are respectively formed at the side wall of the engaging concave portion 37.

Moreover, a handle 24 for holding the liquid jet recording head 51 is formed so as to integrally project at the outer peripheral portion at a side opposite to the side at which the recording unit 15 is provided. The handle 24 becomes a handhold at the time of attaching and removing the liquid jet recording head 51 with respect to the carriage which the recording apparatus has.

The frame body 16 is positioned with respect to the flow path forming member 6 by inserting the bosses 16*a*, 16*b* into the positioning holes 6*c*, 6*d* of the flow path forming member 6. Moreover, in the frame body 16, due to the first snap fittings 18*a*, 18*b* and the second snap fittings 19*a*, 19*b* being respectively engaged with the first catching portions 6*g*, 6*h* and the second catching portions 6*e*, 6*f* of the engaging projections 9*a*, 9*b* of the flow path forming member 6, and due to the hooks 31*a*, 31*b* of the extension piece 31 of the frame body 16 being engaged with the third catching portions 6*m*, 6*n*, the frame body 16 and the flow path forming member 6 are joined and fixed.

In this way, the extension piece 31 is structured such that the hooks 31*a*, 31*b* are engaged with the third catching portions 6*m*, 6*n* of the flow path forming member 6. Thereby, even if external force in a direction of separating from the wiring sheet 3 is applied to the extension piece 31, due to the frictional resistance in the engaged state between the hooks 31*a*, 31*b* and the third catching portions 6*m*, 6*n*, it is possible to prevent the elastic displacement portion 31*d* of the extension piece 31 from causing bending deformation in a direction of canceling the engaged state.

Accordingly, by providing the extension piece 31 at the frame body 16, the length of the elastic displacement portion 31*d* of the extension piece 31 becomes long, and the flexural rigidity of the elastic displacement portion 31*d* becomes small. However, because it is a structure in which the engaged state is not easily released even if the thickness of the elastic displacement portion 31*d* is made small, it is possible to achieve compactness of the entire liquid jet recording head 51.

Note that the extension piece 31 described above is structured so as to be provided at the frame body 16 side. However, although not illustrated, if the extension piece 31 is provided at the flow path forming member 6 side, in the process of adhering the wiring sheet 3, when the wiring sheet 3 is pulled toward the flow path forming member 6 side, the extension piece 31 is an obstruction. Accordingly, in this case, it is necessary to adhere the wiring sheet 3 on the second plate 5 before the flow path forming member 6 is joined. In this way, because the structure in which the extension piece 31 is provided at the flow path forming member 6 side has fewer degrees of freedom of process settings and has deteriorated the productivity, it is not preferable.

Moreover, because the distal end portion 31*c* of the extension piece 31 projects more than the face surface 3*a*, in the recording apparatus, for example, when a recording paper whose tendency to curl is comparatively large passes through or at the time of treatment of paper jamming of the recording paper or the like, even if the recording paper attempts to contact the discharge port, the contact of the recording paper and the discharge port is prevented due to the distal end portion 31*c* of the extension piece 31 contacting the recording paper. Therefore, in accordance with the extension piece 31, the periphery of the discharge port or the face surface 3*a* is not damaged by the recording paper, and troubles such as the recording quality onto a recording paper deteriorating or the like can be avoided.

Further, the set of rail shaped engaging grooves 26, with which the both side ends of the terminal wiring substrate 4 are engaged, are formed at the frame body 16. With respect to these engaging grooves 26, when the frame body 16 and the flow path forming member 6 are joined, due to the distal end portion 4*d* of the terminal wiring substrate 4 entering into the engaging grooves 26, and being fit into up to a predetermined position, the terminal wiring substrate 4 is completely held. Namely, the bottom end portion 4*e* of the terminal wiring substrate 4 is held by the flow path forming member 6, and the top end portion 4*d* of the terminal wiring substrate 4 is held by the engaging grooves 26 of the frame body 16.

In this way, as compared with a structure in which the terminal wiring substrate 4 is fixed by heat-welding to the flow path forming member 6, there is no need to provide spaces for forming holes for heat-tightening on the terminal wiring substrate 4, and the width of the terminal wiring substrate 4 can be made smaller. In accordance therewith, the width of the entire liquid jet recording head 51 can be compact.

Because there is a structure in which the top end portion 4*d* of the terminal wiring substrate 4 is inserted into the engaging grooves 26, when the flow path forming member 6 and the frame body 16 are assembled, the production process for fixing the terminal wiring substrate 4 can be omitted, and an improvement in the productivity can be achieved. In addition, because the terminal wiring substrate 4 can be easily removed, the disassembly operation of the liquid jet recording head 51 is easy, and the structure has an excellent recycling performance as well.

Further, the terminal wiring substrate 4 is held over the flow path forming member 6 and the frame body 16. Therefore, in the flow path forming member 6, because there is no need to provide a space for catching the entire area of the terminal wiring substrate 4 as in the conventional structure, the flow path forming member 6 can be efficiently shape-formed, and can be made compact. Moreover, as described above, because the flow path forming member 6 can be put on the bottom surface the porous member protected without relying on a jig for installing or the like, the installing space is made small, and an improvement in productivity can be markedly achieved.

Furthermore, the liquid jet recording head 51 has a sealing member 20 for airtightly closing the connected areas of the recording liquid flow paths with the frame body 16 and the flow path forming member 6. The sealing member 20 is formed in a frame shape by elastic material such as, for example, rubber, an elastomer or the like. As shown in FIG. 4 and FIG. 5, an upper rib 21 and a lower rib 22 are respectively integrally provided so as to be protruded along the outer periphery at the top surface facing the frame body 16 and the bottom surface facing the flow path forming member 6.

In addition, at the sealing member 20, positioning bosses 20*a* positioned on and engaged with the top surface 6*k* are respectively provided at the respective corner portions on the bottom surface facing the top surface 6*k* of the flow path member 6. Further, on the top surface 6*k* of the flow path member 6, positioning holes 6*j*, with which the respective positioning bosses 20*a* of the sealing member 20 are respectively engaged, are provided along the outer periphery of the porous member 7.

With respect the sealing member 20, after the respective positioning bosses 20*a* are inserted into and positioned at the respective positioning holes 6*j* of the flow path forming member 6, by assembling the frame body 16 and the flow path forming member 6, the upper rib 21 at the top surface side and the lower rib 22 at the bottom surface side are squashed by receiving the nipping-compression by the bottom surface 16*c* of the frame body 16 and the top surface 6*k* of the flow path forming member 6. Therefore, the interior of the common liquid chamber 17 is completely sealed.

In this way, in the liquid jet recording head 51, the recording liquid stored in the common liquid chamber 17 of the frame body 16 is supplied to the recording unit 15, and is supplied to the discharge port of the recording element substrate 1 through the recording liquid supply port 1*b* of the recording element substrate 1 through the recording liquid flow paths of the flow path forming member 6 and the first plate 2 from the porous member 7.

Moreover, at the frame body 16, a joint rubber 23, which is a recording liquid supply port for supplying recording liquid to the common liquid chamber 17, is provided. As shown in FIG. 11, a crack hole 23*b* which is a slit shape forming a Y shape is provided at the center of the end surface of the joint rubber 23. As shown in FIG. 3, the joint rubber 23 is provided so as to be press-fit a circular cylindrical hole portion 16*s* of the frame body 16, whose inside diameter dimension is smaller than the outside diameter dimension of the joint rubber 23. Further, at the joint rubber 23, the distal end portion 23*c* in the press-fitting direction with respect to the frame body 16 is formed so as to be a tapered shape whose diameter decreases toward the distal end, in order to well ensure insertion performance into the cylinder hole portion 16*a*.

In this way, by forming the crack hole 23*b* at the joint rubber 23, when a needle (not shown) for supplying recording liquid of a recording liquid supplying mechanism which the recording apparatus has is inserted, the distal end of the needle cleaves the crack hole 23*b* and is smoothly inserted into the common liquid chamber 17 at the interior of the frame body 16. When the needle is not inserted, because the crack hole 23*b* is closed by receiving compressive load from the outer peripheral portion of the joint rubber 23, the interior of the common liquid chamber 17 can be maintained in a sealed state.

On the other hand, with respect to the joint rubber 23, when the needle is inserted into the crack hole 23*b*, because grip force is applied to the needle by compressive force from the outer peripheral side, the joint portion (not shown) at the outer peripheral side of the needle can be completely sealed.

The joint rubber 23 is disposed so as to be adjacent to 2 places of the top and bottom side surfaces of the frame body 16. The lower joint rubber 23 is a supplying path for supplying recording liquid from a recording liquid storage tank (not shown) which the recording apparatus has, and the recording liquid is supplied into the common liquid chamber 17 through the lower needle.

Further, the upper joint rubber 23 releases air stored in the common liquid chamber 17 to the exterior of the common liquid chamber 17, and is a suction air path for making the interior of the common liquid chamber 17 be negative pressure. Accordingly, negative pressure in the common liquid chamber 17 is controlled by discharging air in the common liquid chamber 17 to the exterior of the common liquid chamber 17 from the needle inserted into the upper joint rubber 23 by a suction air driving means (not shown) such as a pump or the like.

Namely, by increasing the negative pressure in the common liquid chamber 17 by the suction air path, the supplied amount of recording liquid which is replenished to the common liquid chamber 17 can be controlled.

Next, the joined state between the flow path forming member 6 and the frame body 16 of the recording unit 15 will be described further in detail.

The boss 16*a* of the frame body 16 is inserted into the positioning hole 6*c* of the flow path forming member 6, and the boss 16*b* of the frame body 16 is inserted into the positioning hole 6*d* of the flow path forming member 6. The first snap fittings 18*a*, 18*b* of the frame body 16 are engaged with the first catching portions 6*g*, 6*h* of the flow path forming member 6, and the second snap fittings 19*a*, 19*b* of the frame body 16 are engaged with the second catching portions 6*e*, 6*f* of the flow path forming member 6. The hooks 31*a*, 31*b* of the extension piece 31 of the frame body 16 are engaged with the third catching portions 6*m*, 6*n* of the flow path forming member 6, and moreover, the frame body 16 and the flow path forming member 6 nips and pressures the sealing member 20 between the opposing regions thereof. Thereby the respective recording liquid flow paths of the frame body 16 and the flow path forming member 6 are sealed, and both are completely communicated and fixed.

Accordingly, in the liquid jet recording head 51 of the present embodiment, as compared with a form in which the recording unit 15 and the frame body 16 are joined by screws, an adhesive or the like, or a form in which the joined area of the both is sealed through sealing agent or the like, assembly operation and disassembly operation of the recording unit 15 and the frame body 16 are easy. Therefore, the structure is suited for recycling, and the liquid jet recording head 51 can be inexpensively manufactured.

Further, because the first snap fittings 18*a*, 18*b* and the second snap fittings 19*a*, 19*b* are provided so as to be a pair at facing positions in the direction in which the facing hooks thereof respectively engage with the first catching portions 6*g*, 6*h* and the second catching portions 6*e*, 6*f*, the engaged states by the respective hooks are firmly held.

Moreover, the first snap fittings 18*a*, 18*b* are structured such that the longitudinal direction of the elastic displacement member coincides with the joining direction in which the frame body 16 and the flow path forming member 6 are joined. Further, the second snap fittings 19*a*, 19*b* are structured in a direction in which the longitudinal direction of the elastic displacement member perpendicular by intersects joining direction in which the frame body 16 and the flow path forming member 6 are joined. That is, at the first snap fittings and the second snap fittings, the respective elastic displacement portions are structured such that directions of elastic displacement thereof are perpendicular to one another when the frame body 16 and the flow path forming member 6 are joined.

In accordance therewith, when impact force is applied in a direction of canceling and separating the joined state of the frame body 16 and the flow path forming member 6 due to the liquid jet recording head 51 being dropped by accident or the like, tensile stress is applied in the longitudinal direction of the elastic displacement portions of the first snap fittings 18*a*, 18*b*. However, the first snap fittings 18*a*, 18*b* have rigidity which can sufficiently withstand such tensile stress. Therefore, at the first snap fittings 18*a*, 18*b*, the engaged state between the hooks and the first catching portions 6*g*, 6*h* is not released by impact load applied in the longitudinal direction of the elastic displacement portions.

Further, because the frame body 16 and the flow path forming member 6 are joined in a state in which the sealing member 20 is compressed and nipped between the opposing regions thereof, repulsion in the direction of separating frame body 16 and the flow path forming member 6 is always applied by the elastic force of the sealing member 20. Therefore, the elastic displacement portions of the first snap fittings 18*a*, 18*b* are set to a mechanical strength having a tensile strength which can sufficiently withstand such repulsion by the sealing member 20. In the same way, at the extension piece 31, the elastic displacement portion 31*d* is set to a mechanical strength having a tensile strength which can sufficiently withstand the repulsion by the sealing member 20.

In addition, the first snap fittings 18*a*, 18*b* are engaged such that the engaging surfaces of the hooks and the first catching portions 6*g*, 6*h* contact substantially horizontally parallel. Therefore, the joining position of the frame body 16 and the flow path forming member 6 is precisely positioned by the hooks abutting the first catching portions 6*g*, 6*h*.

On the other hand, when impact in a direction of separating the joining between the frame body 16 and the flow path forming member 6 is separated is applied to the places where the second snap fittings 19*a*, 19*b* and the second catching portions 6*e*, 6*f* are engaged, bending stress is applied to the elastic displacement portions of the second snap fittings 19*a*, 19*b*. At the second snap fittings 19*a*, 19*b*, the engaged state of the second snap fittings 19*a*, 19*b* is released by such bending stress. However, because the rigidity with respect to the bending stress is comparatively weak, bending deformation arises when large load is applied.

In addition, as described above, repulsion by the sealing member 20 is always applied to the joined places of the frame body 16 and the flow path forming member 6. Therefore, due to plastic displacement generated by such bending deformation, there is the concern that the frame body 16 and the flow path forming member 6 will move in directions of separating, and deterioration of the accuracy of positioning the relative positions of the frame body 16 and the flow path forming member 6 will occur.

Namely, with respect to such repulsion due to elasticity of the sealing member 20, the withstand load of the first snap fittings 18*a*, 18*b* and the extension piece 31 are ensured to be larger than the withstand load of the second snap fittings 19*a*, 19*b*. Therefore, the hooks of the first snap fittings 18*a*, 18*b* and the hooks 31*a*, 31*b* of the extension piece 31 mainly resist the repulsion load by the sealing member 20, and the engaged state between the frame body 16 and the recording unit 15 is maintained.

Accordingly, due to the extension piece 31 being provided so as to be positioned in the vicinity of the second snap fittings 19*a*, 19*b*, the engagement strength of the hooks 31*a*, 31*b* and the third caching portions 6*m*, 6*n* can be applied so as to compensate for the weak point of the engagement strength in the direction in which the recording unit 15 and the frame body 16 are separated at the second snap fittings 19*a*, 19*b*.

Next, a case will be described in which the first snap fittings 18*a*, 18*b* and the second snap fittings 19*a*, 19*b* are subjected to impact force in an elastic displacement direction.

When impact force is applied in an elastic displacement direction, bending stress is applied to the elastic displacement portions of the first snap fittings 18*a*, 18*b*, and bending deformation is easily caused at the first snap fittings 18*a*, 18*b*. If the hooks of the first snap fittings 18*a*, 18*b* are about to come off from the first catching portions 6*g*, 6*h*, the engaging surfaces of the hooks are inclined with respect to and abut the corner portions of the first catching portions 6*g*, 6*h*, and frictional resistance in such a state of abutment is large. Therefore, for the first snap fittings 18*a*, 18*b*, in order to return to their predetermined engaging positions, it is necessary for the elastic recovery force of the first snap fittings 18*a*, 18*b* to have large load which can withstand the frictional resistance, and it is difficult for the first snap fittings 18*a*, 18*b* to return to their predetermined engaging positions. Further, when impact load is further applied from such a state, the first snap fittings 18*a*, 18*b* withdraw in a direction in which the engaging surfaces of the hooks thereof separate further from the first catching portions 6*g*, 6*h*, and the engaged state with the first catching portions 6*g*, 6*h* is canceled.

On the other hand, the elastic displacement portions of the second snap fittings 19*a*, 19*b* cause bending deformation at the engaging areas at which the second snap fittings 19*a*, 19*b* and the second catching portions 6*e*, 6*f* are engaged with one another, in the same way as the engaged areas at which the first snap fittings 18*a*, 18*b* and the first catching portions 6*g*, 6*h* are engaged with one another. However, at this time, the engaging surfaces of the hooks of the second snap fittings 19*a*, 19*b* abut the second catching portions 6*e*, 6*f* substantially horizontally (in parallel). Even if the second snap fittings 19*a*, 19*b* cause bending deformation, the angle at which the both contact one another hardly changes. Therefore, for the second snap fittings 19*a*, 19*b*, even when the engaging surfaces of the hooks are moved by bending deformation, the frictional resistance applied to the engaging surfaces is relatively small, and the second snap fittings 19*a*, 19*b* can immediately return to a predetermined engaging positions.

In other words, as described above, the liquid jet recording head 51 is structured such that, due to the frame body 16 and the flow path forming member 6 being engaged with one another by the first snap fittings 18*a*, 18*b* and the second snap fittings 19*a*, 19*b* in which the extending directions of the elastic displacement portions thereof are different, when the liquid jet recording head 51 receives impact load applied in the direction of joining the frame body 16 and the flow path forming member 6, the first snap fittings 18*a*, 18*b* and the extension piece 31 work to hold the engaged state, and when the liquid jet recording head 51 receives impact load applied in the hook advancing and withdrawing direction of the first snap fittings, the second snap fittings 19*a*, 19*b* work to hold the engaged state.

Further, the accuracy of the engaging position of the frame body 16 and the flow path forming member 6 is mainly determined by the engagement of the first snap fittings 18*a*, 18*b* having tensile strength which can withstand the load applied in the direction of separating the both, and the first catching portions 6*g*, 6*h* corresponding to these first snap fittings 18*a*, 18*b*. The relative positions of the both are precisely maintained.

On the other hand, when the hooks of the first snap fittings 18*a*, 18*b* receive impact load applied in the direction of elastic displacement, because the engaged state of the second snap fittings 19*a*, 19*b* and the second catching portions 6*e*, 6*f* is not easily released. Therefore, the engaged state of the second snap fittings 19*a*, 19*b* and the second catching portions 6*e*, 6*f* compensates so as to maintain the engaged state of the first snap fittings 18*a*, 18*b* and the first catching portions 6*g*, 6*h*.

Note that, as another means for improving resistance to dropping impact or repulsion due to the sealing member 20 which were described above, there is a method in which the flexural rigidity of the elastic displacement portions is strengthened by increasing the thickness of the elastic displacement portions of the snap fittings. However, in the case of such a method, the snap fittings become large-sized, and accompanying the increase in size, the space for joining the frame body 16 and the flow path forming member 6 is large. Additionally, in the case of such a method, due to the flexural rigidity of the snap fittings increasing, the load required for joining at the time of assembling increases, and the assembling performance deteriorates.

Accordingly, in the present embodiment, because the engaged state of the frame body 16 and the flow path forming member 6 can be firmly fixed without increasing the thickness of the elastic displacement portions of the first and second snap fittings 18*a*, 18*b*, 19*a*, 19*b*, the liquid jet recording head 51 can be manufactured at relatively a low manufacturing cost and so as to be compact. In addition, in the present embodiment, because the load applied at the time when the frame body 16 and the flow path forming member 6 are joined is small, it has excellent productivity.

Next, the wiping operation for cleaning the liquid jet recording head 51 structured as described above will be described. Note that the recording apparatus which has the liquid jet recording head 51 described above and which relates to the present invention will be described later.

In the recording apparatus, there are cases in which recording liquid wetly adheres to the discharge port and the recording liquid discharging surface 1*b* of the recording element substrate 1, and further to the face surface 3*a* of the wiring sheet 3 by mist, satellite or the like which is generated when the recording liquid is discharged from the liquid jet recording head 51. Further, in the recording apparatus, there are cases in which recording liquid of suction residue adheres to the recording liquid discharging surface 1*b* or the face surface 3*a* at the time of suction processing such as sucking the recording liquid by capping from the discharge port by a cap of a recovery unit which will be described later.

Thus, the recording apparatus has a recovery unit (not shown) for carrying out wiping processing in order to remove such residual recording liquid adhering to the recording liquid discharging surface 1*b* or the face surface 3*a*.

The recovery unit has a blade 41 which wipes off the recording liquid by sliding on the recording liquid discharging surface 1*b* and the face surface 3*a* of the liquid jet recording head 51, and a moving mechanism (not shown) moving the blade 41. The recovery unit also has a cap for covering the recording liquid discharging surface 1*b* and the face surface 3*a* of the liquid jet recording head 51, a moving mechanism moving the cap to the recording unit 15, and a suction mechanism for sucking the recording liquid through the cap.

The blade 41 is formed in a substantially flat plate shape from an elastic material such as, for example, rubber, an elastomer or the like, and has elastic restoring force restoring the shape by elastic force when the distal end side is elastically deformed.

Further, at the blade 41, when the width thereof is wider than the width in the short side direction of the wiring sheet 3, a region on which the blade 41 cannot slide is not generated, and therefore, the wiping operation can be efficiently carried out. Accordingly, the width of the blade 41 is preferably made wider than the width of the wiring sheet 3.

In FIG. 17, respective states $m_1$, $m_2$, $m_3$, $m_4$ of the blade 41 respectively denote states of commencement of the wiping operation, during passing the distal end portion 31*c* of the extension piece 31, during the wiping operation (commencement of entering into the face surface 3*a*), and termination of the wiping operation.

The blade 41 moves in the direction of arrow T shown in FIG. 17 from a position of commencement of the wiping operation (state $m_1$). When the distal end side of the blade 41 contacts an outer wall surface of the extension piece 31, the distal end side of the blade 41 slides on and brushes the distal end portion 31*c* and moves while elastically deforming so as to largely curve along the distal end portion 31*c* of the extension piece 31 (state $m_2$).

Then, when the blade 41 further travels in the direction of arrow T, the distal end side thereof enters in the face surface 3*a* of the wiring sheet 3 (state $m_3$). Because the position of the face surface 3*a* of the wiring sheet 3 is further back toward the flow path forming member 6 side than the distal end portion 31*c* of the extension piece 31, when the blade distal end side passes the distal end portion 31*c* of the extension piece 31, the blade 41 immediately reduces the deformation amount of the curved shape along the difference in levels (the difference of the relative positions between the distal end portion 31*c* of the extension piece 31 and the face surface 3*a*) by its own elastic restoring force, and slides on and brushes the face surface 3*a*.

In this way, at the blade 41, when the slide-contacting surface of the distal end side moves from the distal end portion 31*c* of the extension piece 31 toward the face surface 3*a*, the distal end side tries to return to a flat-plate-shaped upright state due to the elastic restoring force of the blade 41 itself. Therefore, the distal end side vigorously moves in the direction of movement of the blade 41.

At this time, because the distal end portion of the blade 41 skips over and passes the side end 3*c* without contacting the side end 3*c* of the wiring sheet 3, it is certainly prevented from catching on the end side 3*c* of the wiring sheet 3. Namely, in accordance with the liquid jet recording head 51 of the present embodiment, due to the wiping operation of the blade 41, the problem of the wiring sheet 3 being peeled off from the side end 3*c* does not exist, and breakage of the wiring sheet 3 can be prevented.

Note that, as described above, the length of the region at which the blade 41 jumps over the side end 3*c* is determined by the material of the blade 41 (the elastic restoring force), the moving speed of the blade 41, the difference in the relative positions (the difference in levels) between the distal end portion 31*c* of the extension piece 31 and the face surface 3*a* of the wiring sheet 3 and the like.

Further, in the liquid jet recording head 51 of the present embodiment, because the difference in levels between the distal end portion 31*c* of the extension piece 31 and the face surface 3*a* is set to be about less than or equal to 1 mm, the distal end side of the blade 41 elastically deforms well without being forced, and the change in the distal end side due to the elastic deformation is smoothly carried out for a short time.

In the liquid jet recording head 51 structured as described above, when the blade 41 enters on the face surface 3*a* of the wiring sheet 3, although the blade 41 jumps over the inner wall surface 31*e* of the extension piece 31 and the side end 3*c* of the wiring sheet 3, the distal end side of the blade 41 maintains the curved shape even after jumping over. Therefore, because the blade 41 is immediately pressed on the face surface 3*a* of the wiring sheet 3 from the spot where the distal end side lands, the wiping operation can be quickly started.

Accordingly, in the liquid jet recording head 51, dust or recording liquid which have adhered to the periphery of the discharge port can be reliably wiped off by the distal end side of the blade 41. Then, when the blade 41 has completely passed the face surface 3*a* of the wiring sheet 3, the blade 41 returns to the shape of its original upright state due to its own elastic restoring force (state $m_4$).

The recording apparatus makes the discharging operation of the recording liquid stable and can obtain good images by cleaning the face surface 3*a* of the wiring sheet 3 and the periphery of the discharge port by the series of wiping operations described above.

Further, because the inner wall surface 31*e* of the extension piece 31 is positioned further upstream than the point of commencement of the wiping operation, the recording liquid carried by the distal end side of the blade 41 does not stay in the vicinity of the inner wall surface 31*e*.

Note that, as might be expected, at the time of the wiping operation, in order to prevent the residual recording liquid which has been flown out in the width direction of the blade 41 and could not be eliminated, or the residual recording liquid which could not be eliminated by one wiping operation or the like from stagnating at region which away from the sliding-contacting region of the blade 41, walls, projections or the like which project higher than the face surface 3*a*, other than the distal end portion 31*c* of the extension piece 31, are not provided at the periphery of the wiring sheet 3.

In addition, when the distal end side of the blade 41 contacts the extension piece 31 and curves, in order to elastically displace the blade 41 in a uniformly curved shaped over the entire region in the direction of the width of the blade 41, it is preferably structured such that the width of the extension piece 31 is made wider than the width of the blade 41 and the entire region of the width of the blade 41 contacts the extension piece 31.

Next, a positioning method by which the liquid jet recording head 51 is positioned with respect to the carriage which the recording apparatus has will be described with reference to FIG. 14 and FIG. 15.

In FIG. 14 and FIG. 15, for convenience of explanation, the entire carriage is not shown, and only one portion of a bottom face portion of the carriage is representatively shown.

An opening portion 61*a* for insertion of the liquid jet recording head 51 is provided at the bottom surface portion of the carriage. Catching portions 61*b*, 61*c* for receiving the cylinder face portions 2*a*, 2*b* of the liquid jet recording head 51 are provided at the inner wall surface of the opening portion 61*a*. Catching surfaces 61*d*, 61*e* for supporting the inserting direction of the liquid jet recording head 51 are provided at the top surface.

When the liquid jet recording head 51 is lowered and inserted into the bottom surface portion 61 of the carriage, the liquid jet recording head 51 is pressed respectively in directions of arrows A, B and C shown in FIG. 14 by a pressing means (not shown) disposed at the carriage. Therefore, the positioning boss 6*a* of the liquid jet recording head 51 contacts the supporting surfaces 61*d*, 61*e* of the carriage, and the cylinder face portions 2*a*, 2*b* of the liquid jet recording head 51 contact the catching portions 61*d*, 61*e* of the carriage, and further, the positioning boss 6*b* of the liquid jet recording head 51 contacts a predetermined catching portion (not shown) at the carriage. Therefore, the liquid jet recording head 51 is precisely positioned with respect to the carriage.

Note that, due to the recording apparatus being structured such that the frame body 16 receives all of the respective pressing forces applied in the directions of arrows A, B and C by the pressing means provided at the carriage, the liquid jet recording head 51 is made to have large-capacity storage (the common liquid chamber 17 is made to have a large volume) and the like. Even if the recording head is a form in which the frame body 16 is made large, there is no need to make the recording unit 15 or the flow path forming member 6 to be large, and the liquid jet recording head 51 can be inexpensively manufactured.

Note that, in the liquid jet recording head 51, positioning with respect to the arrow C direction described above may be structured such that either of the projection portion 16*d* of the frame body 16 and the projection portion 6*b* of the flow path forming member 6 is contacted. Namely, in the case of a structure in which, when the liquid jet recording head 51 is loaded on the carriage, a load, in which the upper side of the liquid jet recording head 51 inclines toward the arrow C direction side (the upper side of the liquid jet recording head 51 bows toward the arrow C direction) is received from the carriage, a structure is preferable in which the projection portion 16*d* of the frame body 16 contacts the carriage. In a case in which the positioning accuracy in the arrow C direction is regarded as important, a structure is preferable in which the assembly errors are few and in which the projection portion 6*b* of the flow path forming member 6 is made to contact.

Further, because the cylinder face portions 2*a*, 2*b* of the second plate 5 which are mounting references of the recording element substrate 1 (first reference plane) are used as a mounting positioning reference portion which positions the liquid jet recording head 51 with respect to the carriage, the inclination amount of the recording element substrate 1 (discharge port row) after the liquid jet recording head 51 is loaded on the carriage is determined by only a value in which the adjusting accuracy of the recording element substrate 1, in which the first reference plane of the first plate 2 serves as a reference, and the contacting accuracy between the first reference plane and the projection portions 61*b*, 61*c* of the carriage are added. The accuracy of the loaded position of the liquid jet recording head 51 with respect to the carriage is extremely good.

Moreover, due to the first plate 2 being formed from a rigid body material such as ceramics or the like, the dimensional accuracy and the geometric accuracy of the first plate 2 are further improved, and the mounting accuracy of the recording element substrate 1 can be markedly improved.

Due to the first plate 2 being formed from a rigid body material, the first reference plane of the first plate 2 does not deform by receiving load when the liquid jet recording head 51 is loaded on the carriage, and therefore, the accuracy of abutment and positioning is extremely good. In addition, even when the liquid jet recording head 51 is frequently attached to and removed from the carriage, because the reference plane of the first plate 2 has excellent wear resistance, the inclination accuracy of the discharge port arranging portion at the time of loading the liquid jet recording head is reliably positioned with good reproducibility, and an improvement in the reliability of the entire recording apparatus can be achieved.

In the liquid jet recording head form in which the recording elements are made to be high-density and the temperature easily rises due to the first plate 2 being formed from alumina, the heat discharging characteristic of alumina can be utilized, and the temperature characteristic of the entire liquid jet recording head is improved. Moreover, alumina has excellent chemical resistance and high rigidity, and processing with high dimension accuracy is possible. Therefore, alumina is suited to various types of characteristics necessary for the first plate 2, and suitable for being used for the first plate 2.

As described above, due to all of the positioning reference portions for positioning with respect to the respective A, B and C directions, e.g., all of the three axial directions when the liquid jet recording head 51 is loaded on the carriage being provided at the recording unit 15, because the member piling-up error and the dimension piling-up error from the recording element substrate 1 to the first plate 2 or the positioning reference portion disposed at the flow path forming member 6 can be reduced, a positional accuracy of the discharge port after the liquid jet recording head 51 is loaded on the carriage is markedly improved.

In this way, because the functions required of the liquid jet recording head 51 are concentrated at the recording unit 15, by adopting a material selection and a mechanical structure in which precise and high mechanical strength can be obtained, the reliability of the dimension reference portion in the liquid jet recording head 51 extremely increases.

On the other hand, with respect to the frame body 16, because an inexpensive material can be selected in a range in which the first snap fittings 18*a*, 18*b*, the second snap fittings 19*a*, 19*b* and the extension piece 31 have desired characteristics, the recording unit 15 is formed such that the required functions are concentrated in the minimum size, and all of the necessary parts of the frame body 16 are formed from inexpensive materials. Therefore, a high-performance liquid jet recording head 51 can be inexpensively manufactured.

Further, with respect to the inclination of the direction of arraying the discharge ports which is the most important for positioning the liquid jet recording head 51, the mounting reference of the recording element substrate 1 and the loading reference of the liquid jet recording head 51 on the carriage are set at the same conditions. Therefore, even in a recording apparatus in which the liquid jet recording head 51 is repeatedly attached to and removed from the carriage, the discharge port is always precisely maintained.

Moreover, due to all of the members structuring the liquid jet recording head 51 being assembled by using the positioning reference portion at the time of loading the carriage as a reference, the liquid jet recording head 51 can be even more precisely manufactured.

The above description is one embodiment of the liquid jet recording head and the recording apparatus of the present invention. As might be expected, the present invention can be applied to either of a recording apparatus in which only a single liquid jet recording head 51 is loaded with respect to the carriage and a recording apparatus in which a plurality of liquid jet recording heads 51 are loaded with respect to the carriage.

It may be a structure in which the positioning reference portion, for positioning in all three dimensional directions (three axial directions) when the liquid jet recording head 51 is loaded on the carriage, is disposed at the flow path forming member 6. Namely, in the liquid jet recording head 51, due to the positioning reference portions being concentrated at one member, high accuracy members and low accuracy members can be clearly distinguished, and the productivity can be improved.

Further, in the present embodiment, the elastic displacement portions of the second snap fittings 19*a*, 19*b* are extended in a direction perpendicular to the engaging direction of the frame body 16 and the flow path forming member 6. However, even if it is structured such that the elastic displacement portions of the second snap fittings 19*a*, 19*b* are extended in a direction inclined at 45° or more with respect to the joining direction of the frame body 16 and the flow path forming member 6, similar effects can be obtained.

Furthermore, the liquid jet recording head of the present embodiment is structured such that the recording unit 15 and the frame body 16 are joined in a state in which the sealing member 20 is nipped between opposing regions thereof. However, it may be another structure in which the sealing member 20 is not provided between the opposing regions thereof, for example, a structure in which the respective recording liquid flow paths at the recording unit 15 side and the frame body 16 side are airtightly sealed by a sealing agent or the like.

Second Embodiment

Figure 18:
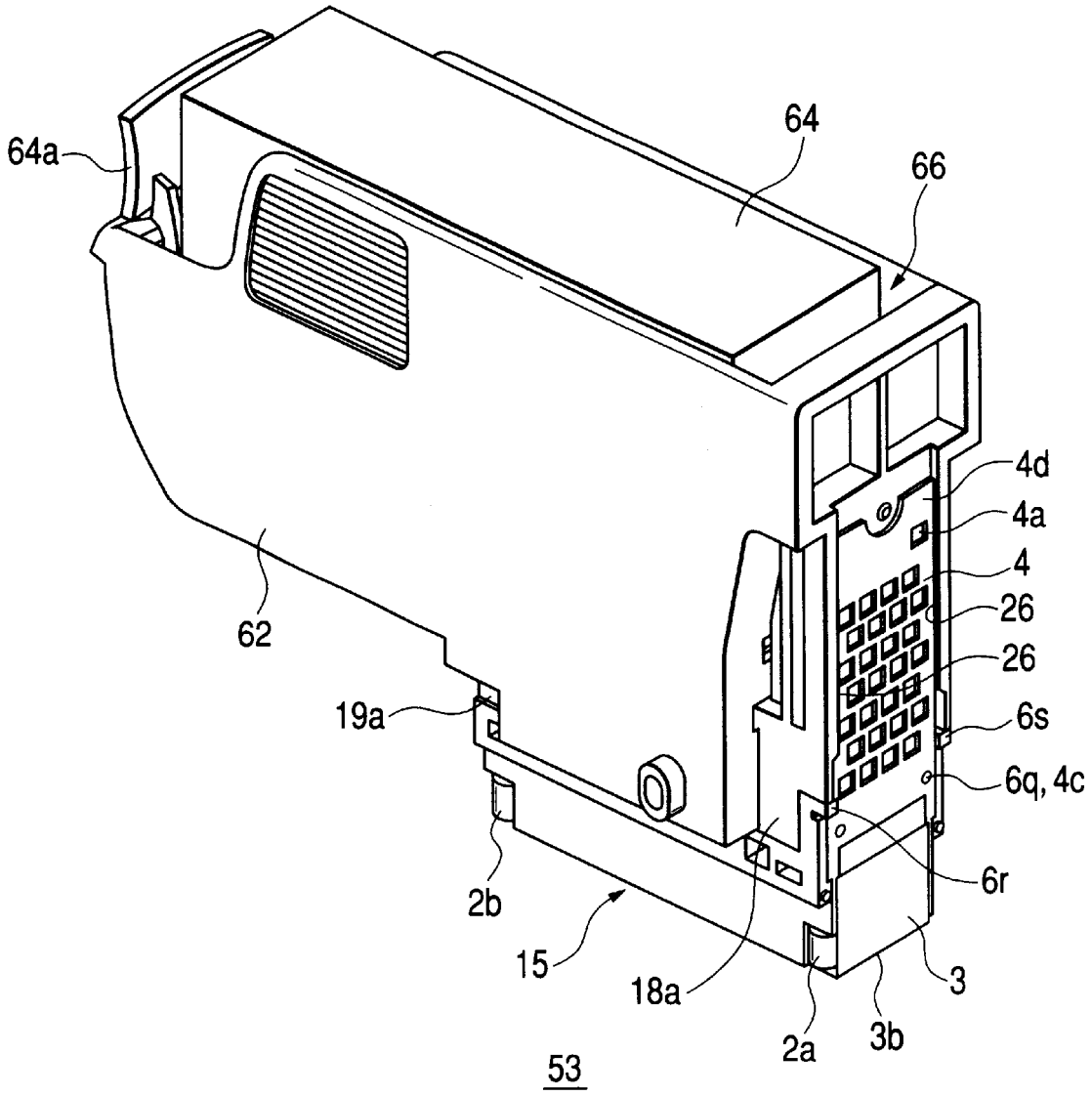
FIG. 18 is a perspective view showing the exterior of a liquid jet recording head, at which a cartridge system ink tank is loaded, of a second embodiment of the present invention.
Figure 19:
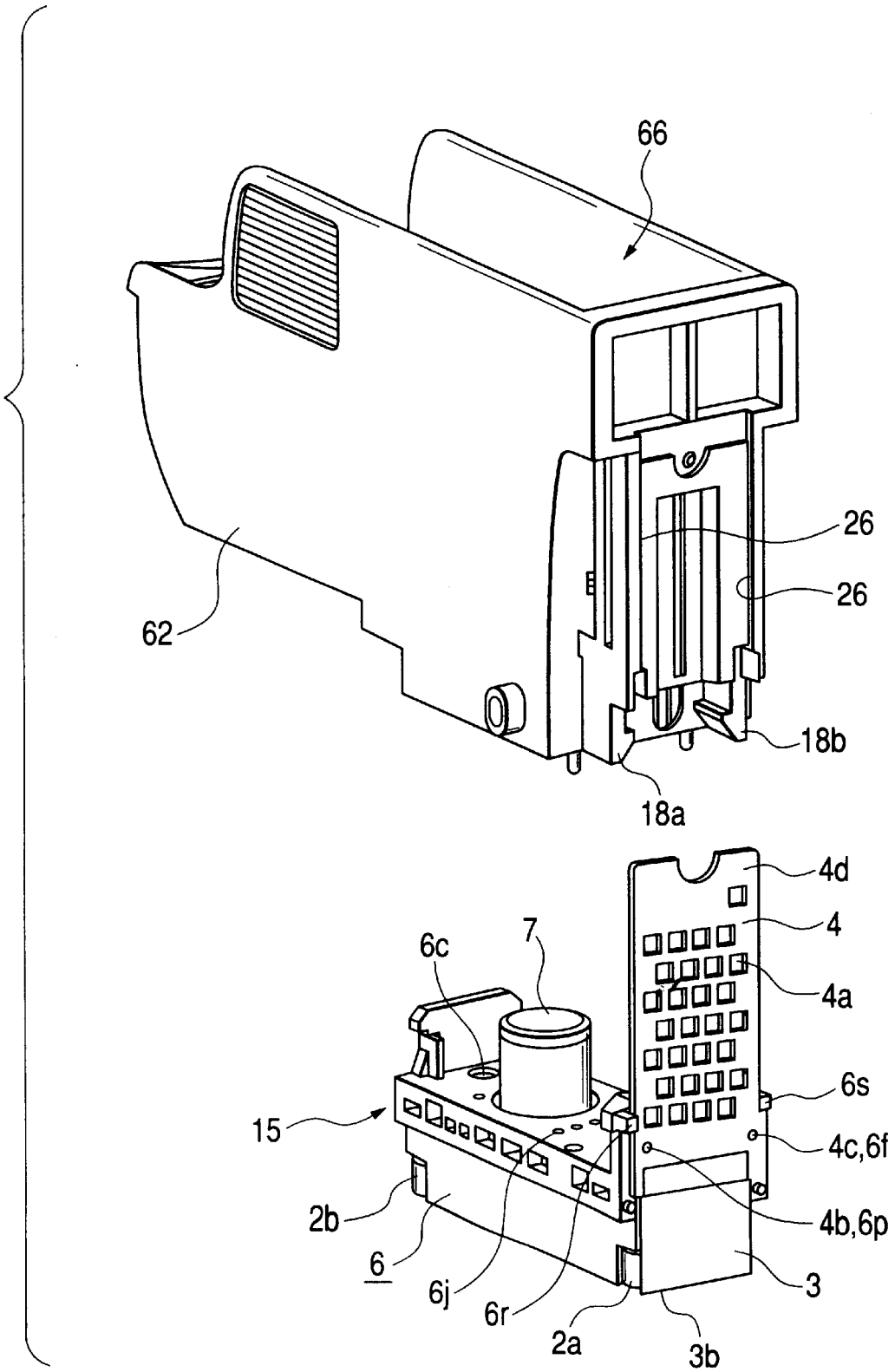
FIG. 19 is an exploded perspective view in which the liquid jet recording head of the second embodiment is shown from a terminal wiring substrate side.
Figure 20:
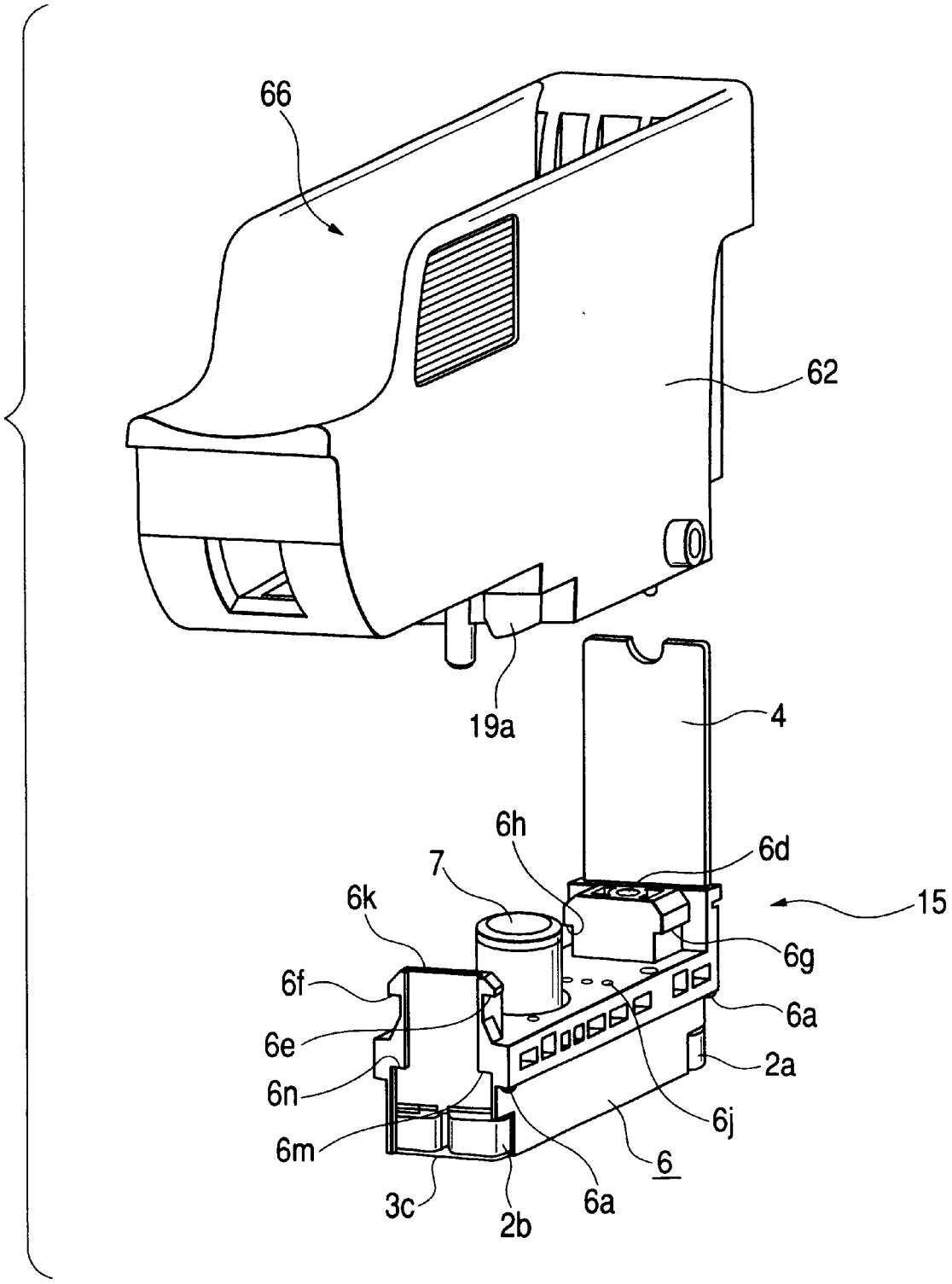
FIG. 20 is an exploded perspective view in which the liquid jet recording head of the second embodiment is shown from a back surface side.
Figure 21:
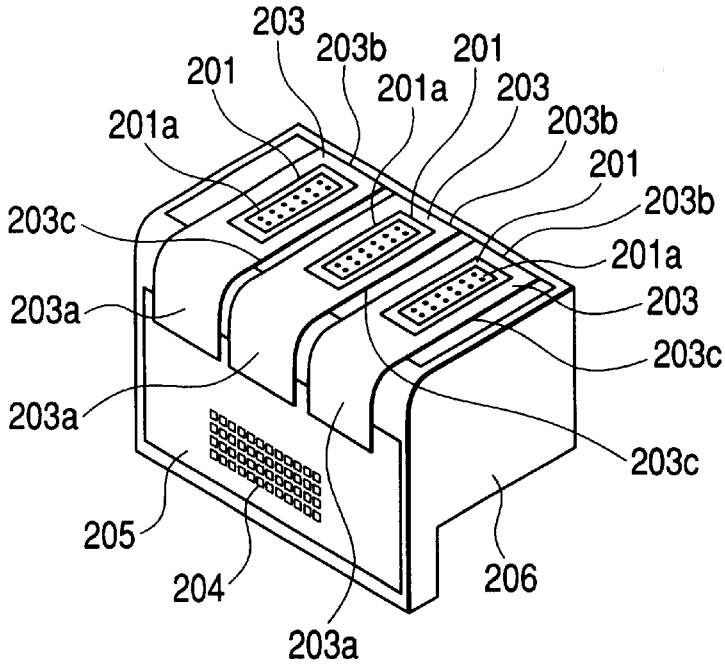
FIG. 21 is a perspective view showing the exterior of a conventional liquid jet recording head.
Figure 22:
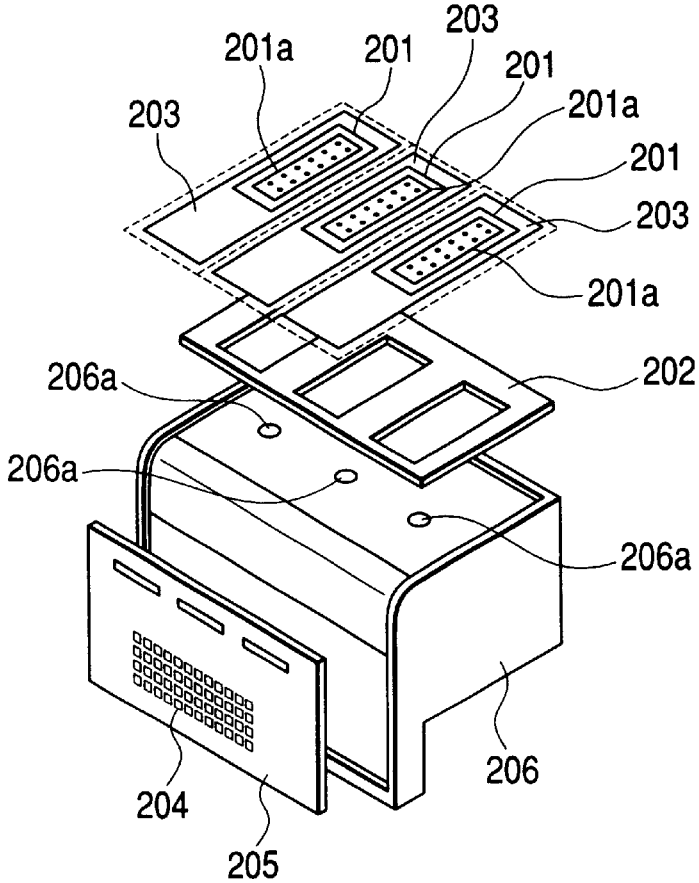
FIG. 22 is an exploded perspective view showing the conventional liquid jet recording head.

FIG. 18 a perspective view of the exterior of a liquid jet recording head of a second embodiment. FIG. 19 and FIG. 20 show an exploded perspective view of the liquid jet recording head.

The present example is applied to a structure of the liquid jet recording head of a form in which a holder member, which has the function of holding and fixing a removable cartridge system ink tank, is joined to the recording unit.

The liquid jet recording head of the present embodiment is structured such that the recording unit is joined to a holder member which detachably holds and fixes a cartridge system ink tank. Note that, with respect to the liquid jet recording head of the second embodiment, parts which are the same as those of the liquid jet recording head 51 of the first embodiment which was described above will be described being denoted by the same reference numerals. Further, parts which are the same as those of the frame body 16 of the liquid jet recording head 51 which was described above are, for convenience, denoted by the same reference numerals, and description thereof will be omitted.

A liquid jet recording head 53 has the recording unit 15 described above and a holder member 62 detachably holding a cartridge system ink tank 64.

A loading portion 66 at which the ink tank 64 is loaded is provided so as to be open at the holder member 62. An engaging piece 64*a*, which is engaged with an engaging portion (not shown) provided at the loading portion 66, is provided at the outer peripheral portion of the ink tank 64. Due to the engaging piece 64*e* engaging, falling out from the interior of the loading portion 66 is prevented.

Also, at the holder member 62, in the same way as in the frame body 16 described above, the first snap fittings 18*a*, 18*b* and the second snap fittings 19*a*, 19*b* are disposed. These first snap fittings 18*a*, 18*b* and second snap fittings 19 are engaged with the first catching portions 6*e*, 6*f* and the second catching portions 6*g*, 6*h* of the recording unit 15. Due to the top end portion 4*d* of the terminal wiring substrate 4 being inserted in and engaged with the engaging grooves 26 of the holder member 62, the holder member 62 and the recording unit 15 are joined and fixed.

Finally, the recording apparatus of the embodiment, at which the recording liquid jet head 51 is provided, will be simply described.

Although not illustrated, the recording apparatus has a recording section having the liquid jet recording head 51 described above which records information such as images or the like on a recording paper, a conveying section conveying the recording paper to the recording section, a discharging section for discharging the recording paper on which information was recorded by the recording section to the exterior of the apparatus, and a recovery unit which was described above.

The conveying section has conveying rollers for conveying the recording papers, and a conveying mechanism which rotates and drives the conveying rollers. In the same way, the discharging section has discharging rollers for discharging the recording papers, and a discharging mechanism which rotates and drives the discharging rollers.

In the recording apparatus structured as described above, information such as a desired image or the like is recorded on a recording paper by conveying the recording paper to the recording section by the conveying rollers of the conveying section and by discharging recording liquid by the liquid jet recording head 51. Then, the discharging section discharges the recording paper, on which information is recorded, to the exterior of the recording apparatus by conveying by the discharging rollers.

Note that, because the wiping operation of the liquid jet recording head 51 by the blade of the recovery unit was described in relation to the liquid jet recording head 51 of the first embodiment which was described above, description thereof will be omitted. Further, it goes without saying that the recording apparatus may be structured so as to have the liquid jet recording head 53 which was described above.

As described above, in accordance with the liquid jet recording heads 51, 53 of the present embodiment, due to the terminal wiring substrate 4 being engaged with and held at the engaging grooves 26 provided at the frame body 16 or the holder member 62, as compared with, for example, a structure in which the terminal wiring substrate 4 is heat-welded and fixed to the flow path forming member 6, there is no need to ensure, on the terminal wiring substrate 4, a spaces for providing a plurality of holes for welding with which pins for welding are engaged. The width of the terminal wiring substrate 4 can be made narrow. In accordance therewith, the widths of the liquid jet recording heads 51, 53 corresponding to the width of the terminal wiring substrate 4 can be made compact.

In accordance with the liquid jet recording heads 51, 53, due to the heights of the engaging projection portions 9*a*, 9*b* of the flow path forming member 6 being formed so as to be somewhat higher than the height of the porous member 7 positioned between the opposing regions of the engaging projection portions 9*a*, 9*b*, damage to the porous member 7 can be prevented, and handling of the flow path forming member 6 in the manufacturing process of the liquid jet recording heads 51, 53 is easy, and the productivity of the liquid jet recording head can be markedly improved.

Further, in accordance with the liquid jet recording heads 51, 53, there is a structure in which the both sides of the top end portion 4*d* of the terminal wiring substrate 4 are inserted into the engaging grooves 26 when the flow path forming member 6 and the frame body 16 or the holder member 62 are joined. Therefore, the machining process (heat-welding, screw-fastening, adhesion or the like) for fixing a terminal wiring substrate as in the structure of the conventional liquid jet recording head can be omitted, and an improvement in productivity can be achieved. Moreover, in accordance with the liquid jet recording heads 51, 53, because the terminal wiring substrate 4 can be easily removed from the frame body 16, the disassembly operation of the liquid jet recording head is easy, and the recycling performance can be improved.

Furthermore, in accordance with the liquid jet recording heads 51, 53, the positioning means with respect to all three axial directions and the positioning means with respect to basic three axial directions of the terminal wiring substrate 4 are provided at the recording unit 15. Therefore, parts which affect the discharging performance and the mechanical accuracy of the liquid jet recording head are concentrated at the recording unit 15. Accordingly, in accordance with the liquid jet recording heads 51, 53, the frame body 16 may only have functions which are least necessary for storing the recording liquid, and it is possible to select inexpensive material for the frame body 16. In the same way, the holder member 62 may be formed so as to detachably hold the cartridge system ink tank 64, and it is possible to select inexpensive materials. Namely, due to the functions and the accuracy of parts which are necessary for the liquid jet recording head being divided completely into two, i.e., the recording unit 15 and the frame body 16 or the holder member 62, the productivity is markedly improved, and as a result, an inexpensive liquid jet recording head can be manufactured.

Moreover, in accordance with the liquid jet recording heads 51, 53, the first and second snap fittings 18*a*, 18*b*, 19*a*, 19*b* and the first and second catching portions 6*e*, 6*f*, 6*g*, 6*h* which are relatively engaged with one another are provided at the recording unit 15 and the frame body 16 or the holder member 62. Therefore, as compared with a structure in which the recording unit 15 and the frame body 16 or the holder member 62 are joined through screws, an adhesive or the like, the productivity is extremely excellent, and the liquid jet recording head can be inexpensively manufactured. In addition, in accordance with the liquid jet recording heads 51, 53, because the engaged states of the first and second snap fittings 18*a*, 18*b*, 19*a*, 19*b* and the first and second catching portions 6*e*, 6*f*, 6*g*, 6*h* can be relatively easily cancelled, the disassembly operation of the liquid jet recording head is easy, and the recycling performance can be improved.

What is claimed is:

1. A liquid jet recording head for carrying out recording on a medium to be recorded, comprising:

a recording element substrate at which a plurality of recording elements for discharging recording liquid are provided;

a wiring sheet which is provided so as to surround a periphery of the recording element substrate and which is for transmitting a recording signal to the recording element substrate;

a wiring substrate which is electrically connected to one end portion of the wiring sheet and has a terminal portion for input of a recording signal from an exterior; and a flow path forming member at which a recording liquid supplying path for supplying recording liquid to the recording element substrate is provided, wherein, when the flow path forming member is joined to a holder member which detachably holds a recording liquid storage unit storing recording liquid at the interior thereof or a recording liquid storage tank storing recording liquid at the interior thereof, in a state in which one end portion of the wiring substrate is supported by the flow path forming member, due to opposing both side end portions of another end portion of the wiring substrate being respectively inserted into and engaged with a set of engaging grooves provided at the recording liquid storage unit or the holder member, the wiring substrate is held by the flow path forming member and the recording liquid storage unit or the holder member.

2. A liquid jet recording head according to claim 1, wherein the wiring substrate is structured such that a surface at which the terminal portion is provided is perpendicular to a recording liquid discharging surface of the recording element substrate.

3. A liquid jet recording head which is structured by joining a holder member, which detachably holds a recording liquid storage unit storing recording liquid at the interior thereof or a recording liquid storage tank storing recording liquid at the interior thereof, to a recording unit for carrying out recording on a medium to be recorded, the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate which is electrically connected to one end portion of the wiring sheet and has a terminal portion for input of a recording signal from an exterior; a flow path forming member at which a recording liquid supplying path for supplying recording liquid to the recording element substrate is provided; and a porous member for filtering recording liquid, and which carries out recording on a medium to be recorded, wherein one end portion of the wiring substrate is supported by the flow path forming member, and due to opposing side end portions of another end portion of the wiring substrate being engaged with a set of engaging grooves provided at the recording liquid storage unit or the holder member, the wiring substrate is held by the flow path forming member and the recording liquid storage unit or the holder member.

4. A liquid jet recording head according to claim 3, wherein the wiring substrate is structured such that a surface at which the terminal portion is provided is perpendicular to a recording liquid discharging surface o f the recording element substrate.

5. A liquid jet recording head according to claim 3, wherein the wiring substrate is held so as to be over the recording unit and the recording liquid storage unit or the holder member.

6. A liquid jet recording head according to claim 3, wherein the recording unit is provided with positioning means for respectively positioning the wiring substrate in three axial directions.

7. A liquid jet recording head according to claim 3, wherein a joining piece having elasticity is provided at one of the recording unit and the recording liquid storage unit or the holder member, and a joining portion to which the joining piece is joined is provided at the other.

8. A liquid jet recording head according to claim 3, wherein projection portions are respectively formed at opposing positions with the porous member therebetween at the recording unit, and distal ends of the projection portions with respect to a direction of thickness of the porous member are formed so as to project more than an end surface of the porous member.

9. A liquid jet recording head according to claim 8, wherein a joining piece having elasticity is provided at one of the recording unit and the recording liquid storage unit or the holder member, and a joining portion to which the joining piece is joined is provided at the other one, and the projection portions are formed by at least one portion of the joining piece or the joining portion.

10. A liquid jet recording head for carrying out recording on a medium to be recorded, comprising:

a recording element substrate at which a plurality of recording elements for discharging recording liquid are provided;

a flexible wiring sheet which is provided so as to surround a periphery of the recording element substrate and which is for transmitting a recording signal to the recording element substrate;

a wiring substrate which is electrically connected to one end portion of the wiring sheet and which has a terminal portion for input of a recording signal from an exterior; and a flow path forming member at which a recording liquid supplying path for supplying recording liquid to the recording element substrate is formed, wherein the liquid jet recording head further comprises holding means for holding one end portion of the wiring substrate in a state of being curved from one of opposing both end portions of the one end portion to another, and when the flow path forming member is joined to a holder member, which detachably holds a recording liquid storage unit storing recording liquid at the interior thereof or a recording liquid storage tank storing recording liquid at the interior thereof, in a state in which one end portion of the wiring substrate is held by the holding means, due to opposing both side end portions of another end portion of the wiring substrate being respectively inserted into and engaged with a set of engaging grooves provided at the recording liquid storage unit or the holder member, the wiring substrate is held by the flow path forming member and the recording liquid storage unit or the holder member.

11. A liquid j et recording head which is structure d by joining a holder member, which detachably holds a recording liquid storage unit storing recording liquid at the interior thereof or a recording liquid storage tank storing recording liquid at the interior thereof, to a recording unit for carrying out recording on a medium to be recorded the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate which is electrically connected to one end portion of the wiring sheet and has a terminal portion for input of a recording signal from an exterior; a flow path forming member at which a recording liquid supplying path for supplying recording liquid to the recording element substrate is provided; and a porous member for filtering recording liquid, wherein one end portion of the wiring substrate is held by holding means provided at the flow path forming member in a state of being curved from one of opposing both end portions of the one end portion to another, and due to opposing both side end portions of the another end portion of the wiring substrate being respectively engaged with a set of engaging grooves provided at the recording liquid storage unit or the holder member, the wiring substrate is held by the flow path forming member and the recording liquid storage unit or the holder member.

12. A liquid jet recording head according to claim 11, wherein the holding means has positioning means for positioning the other end portion of the wiring substrate, a set of engaging portions engaging with the opposing both end portions of the one end portion of the wiring substrate, and a projection which is provided so as to be positioned at the substantial center on a straight line connecting the set of engaging portions and which contacts a rear face of the other end portion of the wiring substrate.

13. A liquid jet recording head according to claim 11, wherein a joining piece having elasticity is provided at one of the recording unit and the recording liquid storage unit or the holder member, and a joining portion to which the joining piece is joined is provided at the other.

14. A liquid jet recording head according to claim 11, wherein projection portions are respectively formed at opposing positions with the porous member therebetween at the recording unit, and distal ends of the projection portions in a direction of thickness of the porous member are formed so as to project more than an end surface of the porous member.

15. A liquid jet recording head which is structured by joining a holder member, which detachably holds a recording liquid storage unit storing recording liquid at the interior thereof or a recording liquid storage tank storing recording liquid at the interior thereof, to a recording unit for carrying out recording on a medium to be recorded, the recording unit comprising: a recording element substrate at which a plurality of recording elements for discharging recording liquid are provided; a flexible wiring sheet which is provided so as to surround a periphery of the recording element substrate and which is for transmitting a recording signal to the recording element substrate; a wiring substrate which is electrically connected to one end portion of the wiring sheet and has a terminal portion for input of a recording signal from an exterior; a flow path forming member at which a recording liquid supplying path for supplying recording liquid to the recording element substrate is provided; and a porous member for filtering recording liquid, wherein the flow path forming member has a positioning portion for positioning the wiring substrate with respect to the flow path forming member, and a set of engaging portions engaging with opposing both end portions of the one end portion of the wiring substrate, the recording liquid storage unit or the holder member has a set of engaging grooves with which opposing both end portions of another end portion of the wiring substrate are respectively inserted and engaged, and in a state in which the one end portion of the wiring substrate is held at the flow path forming member by the positioning portion and the set of engaging grooves, due to the other end portion of the wiring substrate engaging with the engaging grooves, the wiring substrate is held by the flow path forming member and the recording liquid storage unit or the holder member.

16. A liquid jet recording head according to claim 15, wherein a projection is provided at the recording unit which is positioned at the substantial center on a straight line connecting the set of engaging portions, and which contacts a rear face of the other end portion of the wiring substrate.

17. A liquid jet recording head according to claim 16, wherein a distance, in a direction of thickness of the wiring substrate, between an engaging surface at which the engaging portions are engaged with the wiring substrate and a contacting surface at which the projection contacts the wiring substrate, is thinner than a thickness of the wiring substrate.

18. A liquid jet recording head according to claim 16, wherein the set of engaging portions and the projection are provided so as to be positioned in the vicinity of an outer peripheral portion of the recording unit.

19. A liquid jet recording head according to claim 15, wherein a joining piece having elasticity is provided at one of the recording unit and the recording liquid storage unit or the holder member, and a joining portion to which the joining piece is joined is provided at the other.

20. A liquid jet recording head according to claim 15, wherein projection portions are respectively provided at opposing positions with the porous member therebetween at the recording unit, and distal ends of the projection portions in a direction of thickness of the porous member are formed so as to project more than an end surface of the porous member.

21. A liquid jet recording head according to claim 20, wherein a joining piece having elasticity is provided at one of the recording unit and the recording liquid storage unit or the holder member, and a joining portion to which the joining piece is joined is provided at the other, and the projection portions are formed by at least one portion of the joining piece or the joining portion.

* * * * *

UNITED STATES PATENT AND TRADEMARK OFFICE

CERTIFICATE OF CORRECTION

PATENT NO. : 6,659,595 B2 
DATED : December 9, 2003
INVENTOR(S) : Yukuo Yamaguchi et al.

It is certified that error appears in the above-identified patent and that said Letters Patent is hereby corrected as shown below:

Title page,
Item [57], ABSTRACT,
Line 2, "are" should be deleted; and
Line 11, "the" should be deleted.

Column 1,
Line 48, "median" should read -- media --.

Column 3,
Line 62, "elements" should read -- elements are --.

Column 31,
Line 39, "o f" should read -- of --.

Column 32,
Line 35, "j et" should read -- jet --; and "structure d" should read -- structured --.

Signed and Sealed this

Twenty-fifth Day of May, 2004

JON W. DUDAS
*Acting Director of the United States Patent and Trademark Office*